US011613128B2

(12) United States Patent
Oki

(10) Patent No.: US 11,613,128 B2
(45) Date of Patent: Mar. 28, 2023

(54) LIQUID CARTRIDGE INCLUDING IC BOARD WHOSE CENTER ELECTRODE IS ALIGNED WITH LIGHT-BLOCKING PLATE

(71) Applicant: BROTHER KOGYO KABUSHIKI KAISHA, Nagoya (JP)

(72) Inventor: Satoru Oki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 1 day.

(21) Appl. No.: 17/326,471

(22) Filed: May 21, 2021

(65) Prior Publication Data

US 2022/0126590 A1 Apr. 28, 2022

(30) Foreign Application Priority Data

Oct. 26, 2020 (JP) ..... JP2020-179024

(51) Int. Cl.
*B41J 2/175* (2006.01)

(52) U.S. Cl.
CPC ..... *B41J 2/1753* (2013.01); *B41J 2/17566* (2013.01); *B41J 2002/17576* (2013.01)

(58) Field of Classification Search
CPC .. B41J 2/17553; B41J 2/1752; B41J 2/17566; B41J 2/17523; B41J 2/17513; B41J 2/17526; B41J 2/1753; B41J 2002/17576; B41J 2/17503; B41J 2002/17573; B41J 2/175

See application file for complete search history.

(56) References Cited

U.S. PATENT DOCUMENTS

| | | | |
|---|---|---|---|
| 2016/0279959 | A1 | 9/2016 | Okazaki et al. |
| 2018/0093484 | A1 | 4/2018 | Nukui et al. |
| 2018/0093485 | A1 | 4/2018 | Takahashi et al. |
| 2018/0288869 | A1 | 10/2018 | Ota et al. |
| 2020/0070527 | A1 | 3/2020 | Hayashi |

FOREIGN PATENT DOCUMENTS

| | | | |
|---|---|---|---|
| EP | 3 616 924 | A1 | 3/2020 |
| JP | 2016-185648 | A1 | 10/2016 |
| JP | 2018-051907 | A | 4/2018 |

OTHER PUBLICATIONS

International Search Report and Written Opinion issued in corresponding International Patent Application No. PCT/JP2021/019372, dated Aug. 10, 2021.

*Primary Examiner* — Jannelle M Lebron
(74) *Attorney, Agent, or Firm* — Merchant & Gould P.C.

(57) ABSTRACT

A liquid cartridge configured to be inserted in a frontward direction to a printer includes: a housing; a liquid supply portion; a circuit board; a plate; and a detection portion. The circuit board includes an electrode group facing upward in an upright posture of the liquid cartridge. The electrode group includes a first electrode, a second electrode, and a third electrode for grounding. The first to third electrodes are arrayed in a lateral direction crossing the frontward direction and a gravitational direction such that the third electrode is positioned between the first and second electrodes. In the upright posture of the liquid cartridge, the plate and the detection portion are respectively positioned upward and rearward relative to the circuit board. Each of the third electrode and an upper portion of the plate is positioned a datum plane extending in the frontward direction and in the gravitational direction.

20 Claims, 16 Drawing Sheets

LIQUID CARTRIDGE INCLUDING IC BOARD WHOSE CENTER ELECTRODE IS ALIGNED WITH LIGHT-BLOCKING PLATE

CROSS REFERENCE TO RELATED APPLICATION

This application claims priority from Japanese Patent Application No. 2020-179024 filed Oct. 26, 2020. The entire content of the priority application is incorporated herein by reference.

TECHNICAL FIELD

The present disclosure relates to a liquid cartridge storing liquid therein and a liquid-consuming device to which the liquid cartridge is attachable.

BACKGROUND

Conventionally, there has been known an inkjet recording apparatus configured to print an image on a recording medium by ejecting ink stored in an ink cartridge through nozzles. Whenever ink stored in an ink cartridge runs out, a new ink cartridge is detachably mounted in such an inkjet recording apparatus.

For example, Japanese Patent Application Publication No. 2018-051907 discloses an ink cartridge attachable to and detachable from a printer. The ink cartridge has a front surface on which an ink supply portion is disposed. During attachment of the ink cartridge to the printer, an ink needle of the printer is inserted into the ink supply portion, thereby providing positioning of the ink cartridge in the printer. Further, an IC board, a detection-target portion and a light-blocking plate are mounted on an upper surface of a housing of the ink cartridge. Upon attachment of the ink cartridge to the printer, the IC board is electrically connected to a contact of the printer, and the detection-target portion and light-blocking plate are respectively detected by a residual amount sensor and an attachment sensor of the printer.

SUMMARY

It is an object of the present disclosure to provide a novel liquid cartridge different from the conventional liquid cartridge.

In order to attain the above and other objects, the present disclosure provides a liquid cartridge including a housing, a liquid supply portion, a circuit board, a plate, and a detection portion. The housing defines therein a liquid chamber for storing liquid. The liquid supply portion protrudes in a frontward direction crossing a gravitational direction from a front surface of the housing. The liquid supply portion is configured to supply the liquid in the liquid chamber to an outside of the liquid cartridge. The circuit board includes an electrode group and has a width in a lateral direction crossing the frontward direction and the gravitational direction. The electrode group faces upward in an upright posture of the liquid cartridge and is exposed to the outside. The electrode group includes a first electrode, a second electrode, and a third electrode. The plate has an upper portion. The plate is positioned upward and rearward relative to the circuit board and extends in the frontward direction in the upright posture of the liquid cartridge. The detection portion is configured to receive light traveling in the lateral direction and change a state of the light depending on an amount of the liquid stored in the liquid chamber. The detection portion is positioned upward and rearward relative to the circuit board in the upright posture of the liquid cartridge. The first electrode, the second electrode and the third electrode are arrayed in the lateral direction such that the third electrode is positioned between the first electrode and the second electrode in the lateral direction. The third electrode is an electrode for grounding. Each of the third electrode and the upper portion of the plate is positioned on a datum plane extending in the frontward direction and in the gravitational direction.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
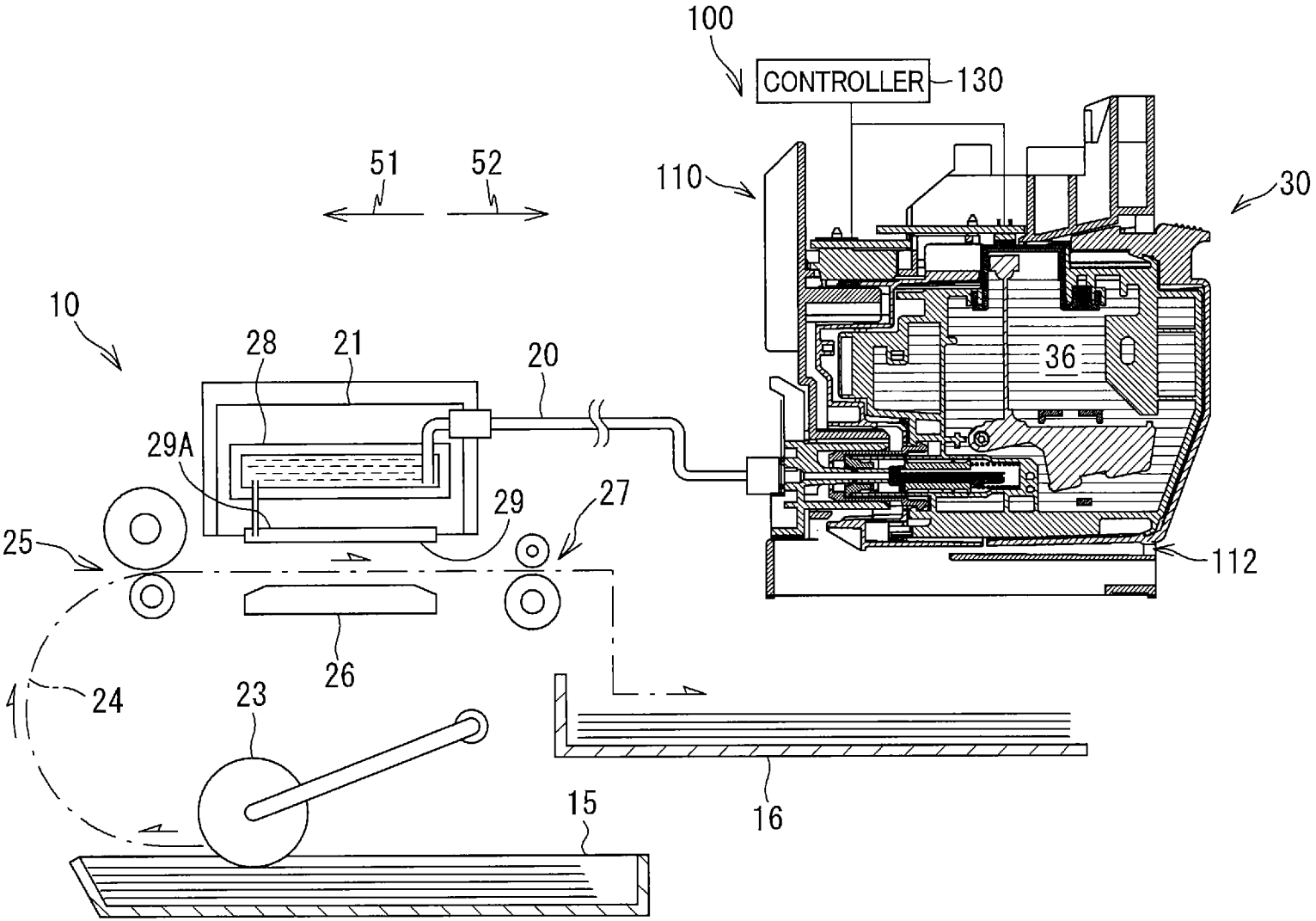
FIG. 1 is a schematic cross-sectional diagram conceptually showing an internal configuration of a printer provided with a cartridge-attachment section configured to detachably accommodate an ink cartridge according to an embodiment of the present disclosure.

Hereinafter, one embodiment of the disclosure will be described in detail while referring to accompanying drawings. It would be apparent to those skilled in the art that the embodiment described below is merely an example of the present disclosure and modifications and variations may be made therein without departing from the scope of the disclosure.

In the following description, a frontward direction 51 is defined as a direction in which an ink cartridge 30 according to the embodiment is inserted into a cartridge-attachment section 110, and a rearward direction 52 is defined as a direction opposite the frontward direction 51, that is, a direction in which the ink cartridge 30 is extracted from the cartridge-attachment section 110. In the present embodiment, the frontward direction 51 and rearward direction 52 are parallel to a horizontal direction which is perpendicular to a gravitational direction. However, the frontward direction 51 and rearward direction 52 need not be parallel to the horizontal direction.

Further, a downward direction 53 is defined as a direction coincident with the gravitational direction, and an upward direction 54 is defined as a direction opposite the downward direction 53 (gravitational direction). Further, a rightward direction 55 and a leftward direction 56 are defined as directions perpendicular to both the frontward direction 51 and the downward direction 53. More specifically, in a state where the ink cartridge 30 has been completely received in the cartridge-attachment section 110, i.e., in a state where the ink cartridge 30 is in an attached posture (an attached state of the ink cartridge 30), and when a user views the ink cartridge 30 from its front side, the rightward direction 55 is a direction toward the right and the leftward direction 56 is a direction toward the left. Further, the posture of the ink cartridge 30 in the attached state (depicted in FIGS. 1 and 5-9) can be referred to as an upright posture of the ink cartridge 30.

In the following description, whenever appropriate, the frontward direction 51 and the rearward direction 52 may be collectively referred to as a front-rear direction 51, 52 (as a direction interchangeable with each other). The upward direction 54 and the downward direction 53 may be collectively referred to as an up-down direction 53, 54 (as a direction interchangeable with each other). The rightward direction 55 and the leftward direction 56 may be collectively referred to as a right-left direction 55, 56 (as a direction interchangeable with each other).

Further, in this specification, "facing frontward" includes facing in a direction including a frontward component, "facing rearward" includes facing in a direction including a rearward component, "facing downward" includes facing in a direction including a downward component, and "facing upward" includes facing in a direction including an upward component. For example, "a front surface faces frontward" denotes that the front surface may face in a frontward direction, or the front surface may face in a direction inclined relative to the frontward direction.

<Overview of Printer 10>

First, a printer 10 configured to receive the ink cartridge 30 according to the embodiment will be described with reference to FIG. 1.

The printer 10 is configured to form an image by selectively ejecting ink droplets onto a sheet based on an inkjet recording system. As shown in FIG. 1, the printer 10 includes a recording head 21, an ink-supplying device 100, and an ink tube 20 connecting the recording head 21 to the ink-supplying device 100. The ink-supplying device 100 includes the cartridge-attachment section 110. The cartridge-attachment section 110 can detachably receive the ink cartridge 30 therein.

The cartridge-attachment section 110 has a surface formed with an opening 112. The ink cartridge 30 can be inserted into the cartridge-attachment section 110 in the frontward direction 51 through the opening 112, and extracted from the cartridge-attachment section 110 in the rearward direction 52 through the opening 112.

The ink cartridge 30 stores therein ink that can be used by the printer 10 for printing. The ink cartridge 30 is connected to the recording head 21 through the ink tube 20 when the ink cartridge 30 has been completely mounted in the cartridge-attachment section 110.

The recording head 21 includes a sub tank 28 for temporarily storing ink supplied from the ink cartridge 30 through the ink tube 20. The recording head 21 also includes a plurality of nozzles 29 through which the ink supplied from the sub tank 28 is selectively ejected in accordance with the inkjet recording system. More specifically, the recording head 21 includes a head control board (not shown), and piezoelectric elements 29A each corresponding to one of the nozzles 29. The head control board is configured to selectively apply drive voltages to the respective piezoelectric elements 29A to eject ink selectively from the nozzles 29. In this way, the recording head 21 is configured to consume the ink stored in the ink cartridge 30 attached to the cartridge-attachment section 110.

The printer 10 also includes a sheet tray 15, a sheet feeding roller 23, a conveying path 24, a pair of conveying rollers 25, a platen 26, a pair of discharge rollers 27, and a discharge tray 16. Each sheet accommodated in the sheet tray 15 is fed therefrom by the sheet feeding roller 23 to the conveying path 24, and then conveyed by the conveying rollers 25 onto the platen 26. The recording head 21 is configured to selectively eject ink onto the sheet as the sheet moves over the platen 26, thereby recording an image on the sheet. The sheet that have passed the platen 26 is then discharged by the discharge rollers 27 onto the discharge tray 16 disposed at a downstream end of the conveying path 24.

<Ink-Supplying Device 100>

The ink-supplying device 100 is provided in the printer 10, as shown in FIG. 1. The ink-supplying device 100 functions to supply ink to the recording head 21. As described above, the ink-supplying device 100 includes the cartridge-attachment section 110 for detachably receive the ink cartridge 30 therein. FIG. 1 shows a state where the ink cartridge 30 has been completely received in the cartridge-attachment section 110. In other words, the ink cartridge 30 is in the attached state in FIG. 1.

<Cartridge-Attachment Section 110>

Figure 2:
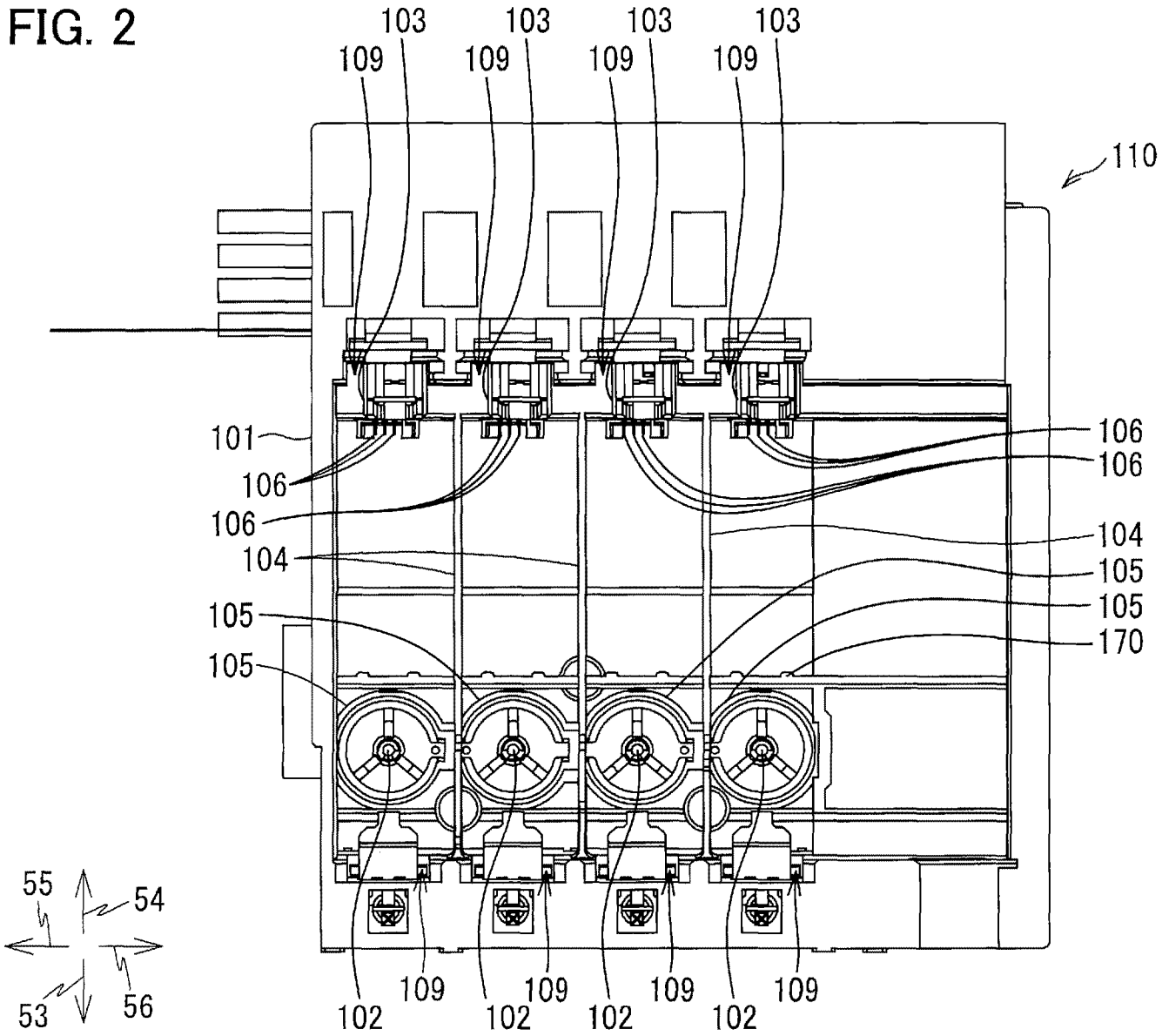
FIG. 2 is a view showing an external appearance of the cartridge-attachment section.
Figure 10:
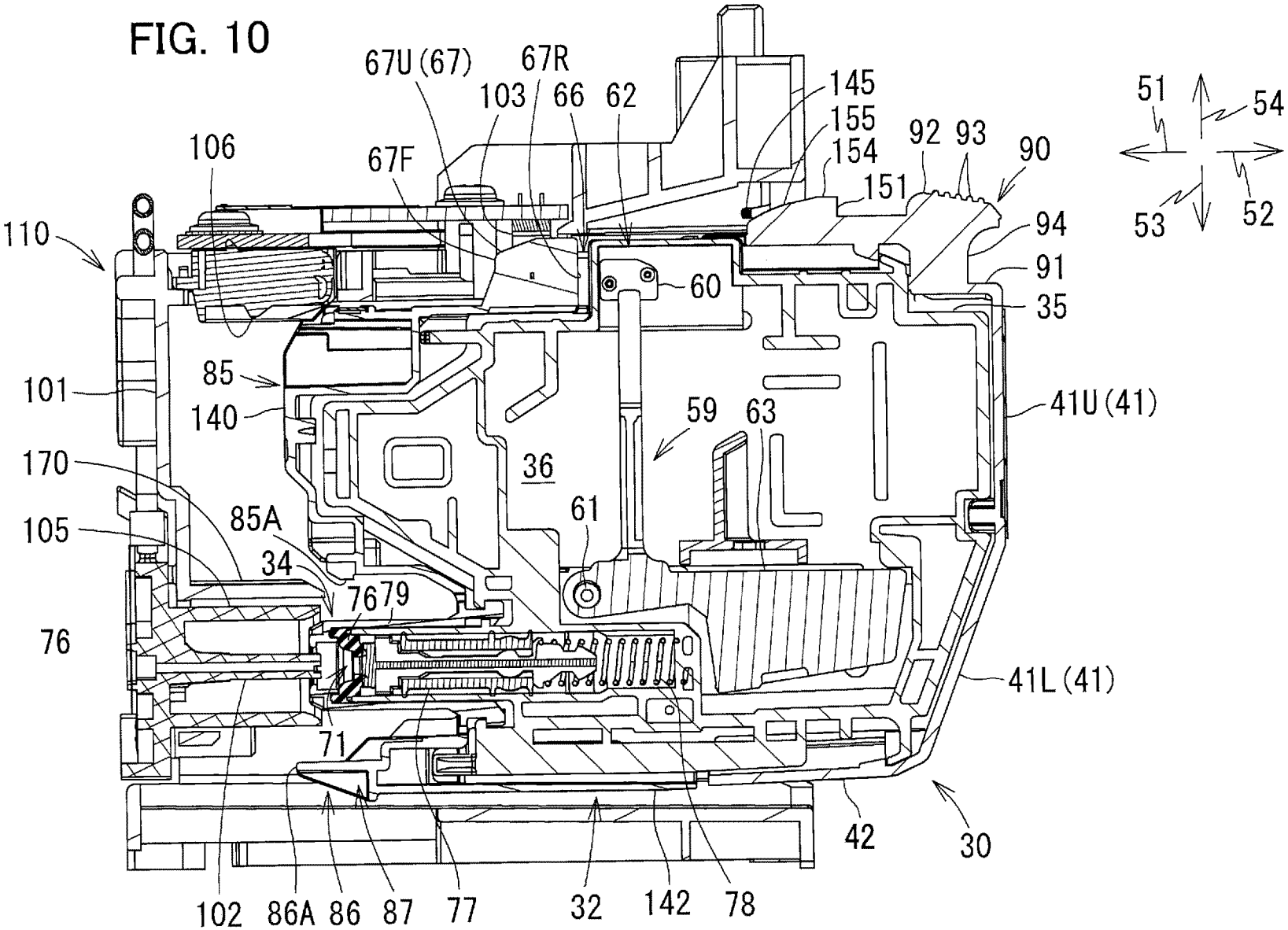
FIG. 10 is a vertical cross-sectional view illustrating the ink cartridge according to the embodiment and the cartridge-attachment section, and particularly illustrating a state where a light-blocking plate of the ink cartridge is detected by a sensor of the cartridge-attachment section.

As illustrated in FIGS. 2 and 10, the cartridge-attachment section 110 includes a case 101, four ink needles 102, four sensors 103, four sets of three contacts 106, and a locking portion 145. In the cartridge-attachment section 110, four kinds of ink cartridges 30 corresponding to four colors of cyan, magenta, yellow and black are detachably mountable. Accordingly, one ink needle 102, one sensor 103, and one set of three contacts 106 are provided for each of the four kinds of ink cartridges 30.

<Case 101>

The case 101 constitutes a housing of the cartridge-attachment section 110. The case 101 has a box-like shape defining an internal space therein and has an open end serving as the opening 112. Specifically, the case 101 includes a top wall defining a ceiling of the internal space, a bottom wall defining a bottom of the internal space, and an end wall connecting the top wall to the bottom wall. The opening 112 of the case 101 is positioned opposite the end wall in the front-rear direction 51, 52. The opening 112 can be exposed to a surface (user-interface surface) that a user can face when using the printer 10.

The four kinds of ink cartridges 30 can be inserted into and removed from the case 101 through the opening 112. In the case 101, each of the top wall and the bottom wall is formed with four guide grooves 109 for guiding insertion/removal of the ink cartridges 30. Specifically, when the ink cartridge 30 is inserted into and removed from the case 101 through the opening 112, upper and lower ends of the ink cartridge 30 are received in the corresponding upper and lower guide grooves 109 and guided thereby in the front-rear direction 51, 52, as shown in FIG. 10. Further, the case 101 also includes three plates 104 that partition the internal space into four individual spaces each elongated in the up-down direction 53, 54. Each of the four ink cartridges 30 can be mounted in a corresponding one of the four spaces defined in the case 101 by the plates 104.

<Ink Needles 102>

Each ink needle 102 is formed of a resin and has a generally tubular shape. As shown in FIG. 2, the ink needles 102 are disposed on a lower end portion of the end wall constituting the case 101. Specifically, the ink needles 102 are arranged at positions each corresponding to an ink supply potion 34 (described later) of the corresponding ink cartridge 30 mounted in the cartridge-attachment section 110. Each ink needle 102 protrudes rearward from the end wall of the case 101.

Four cylindrical-shaped guide portions 105 are provided on the end wall each to surround the corresponding ink needle 102. Each guide portion 105 protrudes rearward from the end wall to have a protruding end that is open rearward. Each ink needle 102 is positioned at a diametrical center of the corresponding guide portion 105. Each guide portion 105 is so shaped that the ink supply potion 34 of the corresponding ink cartridge 30 can be received in the guide portion 105.

Figure 11:
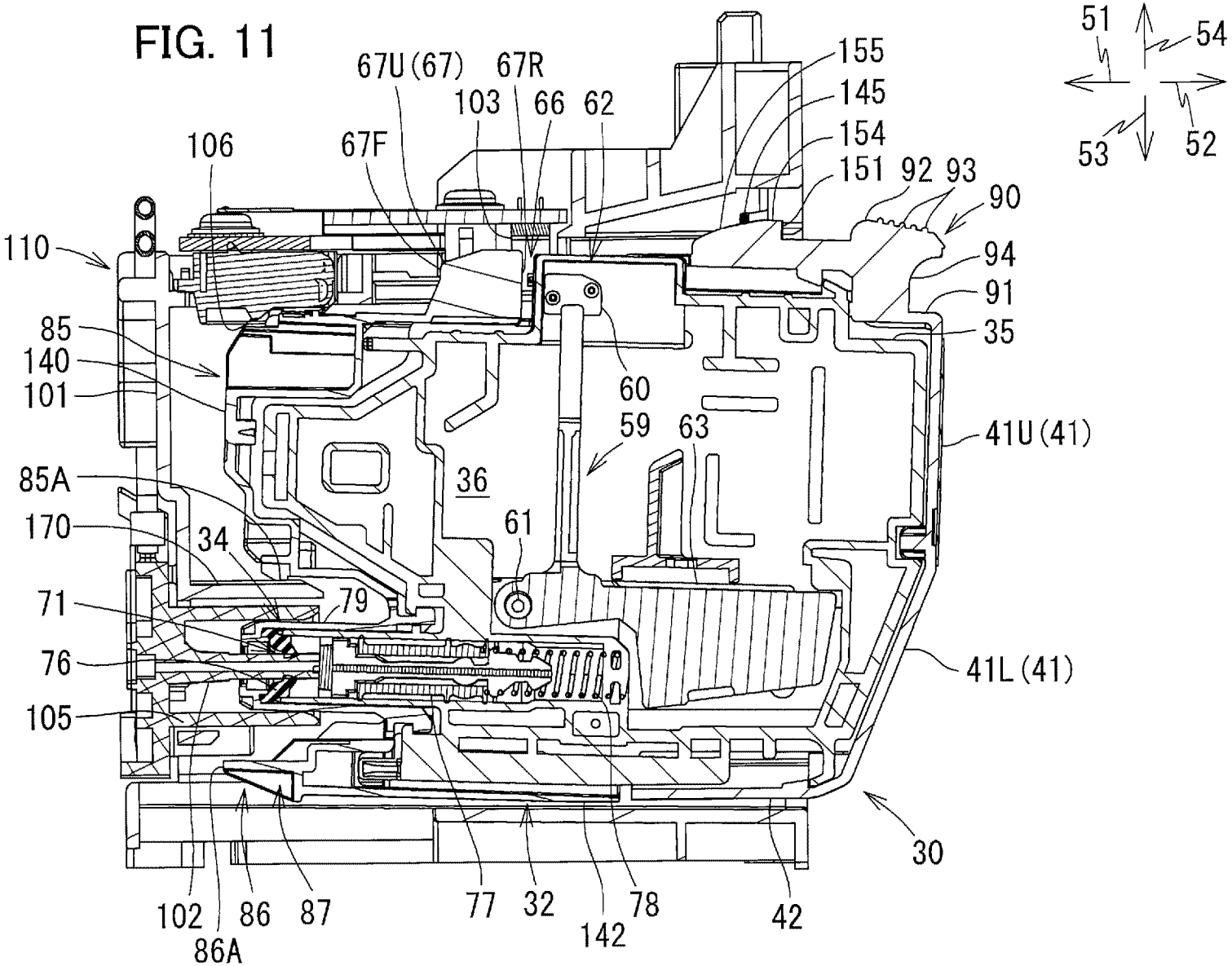
FIG. 11 is a vertical cross-sectional view illustrating the ink cartridge according to the embodiment and the cartridge-attachment section, and particularly illustrating a state where: an ink needle of the cartridge-attachment section has entered in an ink supply port of an ink supply portion of the ink cartridge; and a space provided in the ink cartridge is positioned on a light path of the cartridge-attachment section.

During insertion of the ink cartridge 30 into the cartridge-attachment section 110 in the frontward direction 51, i.e., in the course of action for bringing the ink cartridge 30 into a mounted position mounted in the cartridge-attachment section 110, the ink supply potion 34 of the ink cartridge 30 enters into the corresponding guide portion 105 (see FIG. 11). As the ink cartridge 30 is further inserted forward, the ink needle 102 enters into an ink supply port 71 of the ink supply potion 34. The ink needle 102 is thus connected to the ink supply potion 34, which provides positing of the ink supply potion 34 relative to the cartridge-attachment section 110. Since the ink needle 102 and the ink supply potion 34 are in communication with each other, ink stored in an ink chamber 36 formed in the ink cartridge 30 is allowed to flow into the ink tube 20 connected to the ink needle 102 through an internal space defined in the ink supply potion 34 and an inner space defined in the ink needle 102. Incidentally, the ink needle 102 may have a flat-shaped tip end or a pointed tip end.

<Locking Portion 145>

As illustrated in FIG. 10, the locking portion 145 is provided near the top wall of the case 101 and adjacent to the opening 112 to extend in the right-left direction 55, 56. The locking portion 145 is a rod-shaped member extending in the right-left direction 55, 56. For example, the locking portion 145 is a columnar member made of meal. Left and right ends of the locking portion 145 are respectively connected and fixed to left and right side walls constituting the case 101. Hence, the locking portion 145 is immovable relative to the case 101 and does not make any relative movement (such as pivoting) thereto. The locking portion 145 extends in the right-left direction 55, 56 across the four individual spaces defined in the case 101. In each of the four spaces for receiving corresponding one of the ink cartridges 30, the locking portion 145 is accessible from below and from frontward by the ink cartridge 30 inserted in the space of the case 101 due to a space available around the locking portion 145.

The locking portion 145 functions to hold the ink cartridge 30 in its mounted position in the cartridge-attachment section 110. Specifically, the ink cartridge 30 inserted in the cartridge-attachment section 110 is pivoted upward into the attached posture to be engaged with the locking portion 145, so that the locking portion 145 can hold the ink cartridge 30 in the attached posture (mounted position) in the cartridge-attachment section 110 against a rearward urging force generated by a coil spring 78 in the ink cartridge 30.

<Contacts 106>

As shown in FIGS. 2 and 10, four sets of three contacts 106 are disposed on the top wall of the case 101 at positions near the end wall of the case 101. As illustrated in FIG. 2, the three contacts 106 in each set are arranged to be spaced apart from one another in the right-left direction 55, 56. This arrangement of the three contacts 106 in each set corresponds to an arrangement of an electrode group 65 (consisting of three electrodes 65A-65C as will be described later) of the ink cartridge 30 (see FIGS. 3A and 4A). Each contact 106 is formed of a material having electrical conductivity and resiliency. The contacts 106 are upwardly resiliently deformable.

As described earlier, four sets of the three contacts 106 are provided at the case 101 one set for each one of the four kinds of ink cartridges 30 mountable in the case 101.

Each contact 106 is electrically connected to a controller 130 provided in the printer 10 (see FIG. 1) via electrical circuits. The controller 130 includes a CPU, a ROM, and a RAM, for example. The controller 130 may be configured as a controller of the printer 10. When the contacts 106 are electrically connected to the electrode group 65 of the corresponding ink cartridge 30, a voltage Vc is applied to a power-supply electrode 65A; reading and writing of electrical signals are performed through a signal electrode 65B; and a grounding electrode 65C is grounded. Due to the establishment of the electrical connection between the signal electrode 65B and the corresponding contact 106, data stored in an IC of the ink cartridge 30 is made electrically accessible. Outputs from the electrical circuits are configured to be inputted into the controller 130.

<Sensor 103>

As illustrated in FIGS. 2 and 10, four of the sensors 103 are disposed at the top wall of the case 101. Each sensor 103 includes a light-emitting element and a light-receiving element. The light-emitting element and the light-receiving element are arranged to oppose and to be spaced apart from each other in the right-left direction 55, 56. When the ink cartridge 30 has been attached to the cartridge-attachment section 110, a detection portion 62 (described later) of the ink cartridge 30 is positioned between the light-emitting element and the light-receiving element of the corresponding sensor 103 in the right-left direction 55, 56. In other words, the light-emitting element and the light-receiving element of the sensor 103 are arranged to oppose each other with the detection portion 62 of the attached ink cartridge 30 interposed therebetween.

The light-emitting element is configured to emit light in the right-left direction 55, 56, and the light-receiving element is configured to receive the light emitted from the light-emitting element. The sensor 103 is configured to output different detection signals depending on whether the light emitted from the light-emitting element is received by the light-receiving element. For example, the sensor 103 outputs a low-level signal (a signal whose level is less than a threshold level) when the light emitted from the light-emitting element is not received by the light-receiving element (i.e., when an intensity of the light received at the light-receiving element is less than a predetermined intensity). On the other hand, the sensor 103 outputs a high-level signal (a signal whose level is equal to or greater than the threshold level) when the light emitted from the light-emitting element is received by the light-receiving element (i.e., when the intensity of the light received at the light-receiving element is equal to or greater than the predetermined intensity).

<Ink Cartridge 30>

The ink cartridge 30 is a container configured to store ink therein. The ink cartridge 30 defines an inner space therein serving as the ink chamber 36 configured to store ink. In the present embodiment, the ink chamber 36 is formed by an inner frame 35 which is accommodated in a rear cover 31 and a front cover 32 those constituting an outer shell of the ink cartridge 30.

The posture of the ink cartridge 30 shown in FIGS. 3A to 5 and 9 is a posture when the ink cartridge 30 is in the attached state, i.e., the attached posture of the ink cartridge 30. As will be described later, the ink cartridge 30 includes a front wall 140, a rear wall 41, top walls 39 and 141, and bottom walls 42 and 142. In the attached posture of the ink cartridge 30 depicted in FIGS. 3A to 5 and 9, a direction from the rear wall 41 toward the front wall 140 is coincident with the frontward direction 51; a direction from the front wall 140 toward the rear wall 41 is coincident with the rearward direction 52; a direction from the top walls 39 and 141 toward the bottom walls 42 and 142 is coincident with the downward direction 53, and a direction from the bottom walls 42 and 142 toward the top walls 39 and 141 is coincident with the upward direction 54.

In the attached state of the ink cartridge 30 to the cartridge-attachment section 110, the front wall 140 faces frontward; the rear wall 41 faces rearward; the bottom walls 42 and 142 face downward; and the top walls 39 and 141 face upward.

As illustrated in FIGS. 3A to 9, the ink cartridge 30 includes the rear cover 31, the front cover 32, and the inner frame 35 defining the ink chamber 36. The rear cover 31 has a substantially rectangular parallelepiped shape. The front cover 32 has a substantially rectangular parallelepiped shape. The rear cover 31 includes the rear wall 41. The front cover 32 includes the front wall 140. The front cover 32 is assembled to the rear cover 31 to form the outer shell of the ink cartridge 30. The inner frame 35 is accommodated in the rear cover 31 and the front cover 32 assembled to each other.

In the attached posture, the ink cartridge 30 has a depth in the front-rear direction 51, 52, a height in the up-down direction 53, 54, and a width in the right-left direction 55, 56. The ink cartridge 30 has a generally flat shape having the height in the up-down direction 53, 54 and the depth in the front-rear direction 51, 52 greater than the width in the right-left direction 55, 56. A front surface of the front wall 140A is a surface of the front cover 32 facing forward in an insertion direction (frontward) during insertion of the ink cartridge 30 into the cartridge-attachment section 110. A rear surface of the rear wall 41 is a surface of the rear cover 31 facing backward in a removal direction (rearward) during the insertion of the ink cartridge 30 into the cartridge-attachment section 110. That is, the rear wall 41 and the front wall 140 are disposed to oppose each other with the ink chamber 36 interposed therebetween in the attached posture of the ink cartridge 30.

<Rear Cover 31>

As illustrated in FIGS. 3A to 4B, the rear cover 31 includes the rear wall 41, side walls 37 and 38, the top wall 39, and the bottom wall 42. The side walls 37 and 38 are spaced apart from each other in the right-left direction 55, 56. The top wall 39 and the bottom wall 42 are spaced apart from each other in the up-down direction 53, 54. The side walls 37 and 38, the top wall 39 and the bottom wall 42 extend frontward from the rear wall 41. That is, the rear cover 31 has a box-like shape formed with an opening that is open frontward. The inner frame 35 is inserted into the rear cover 31 via this opening. In other words, the rear cover 31 covers a rear portion of the inner frame 35. In a state where the inner frame 35 is inserted in the rear cover 31, the ink chamber 36 is arranged to be interposed between the top wall 39 and the bottom wall 42.

Figure 5:
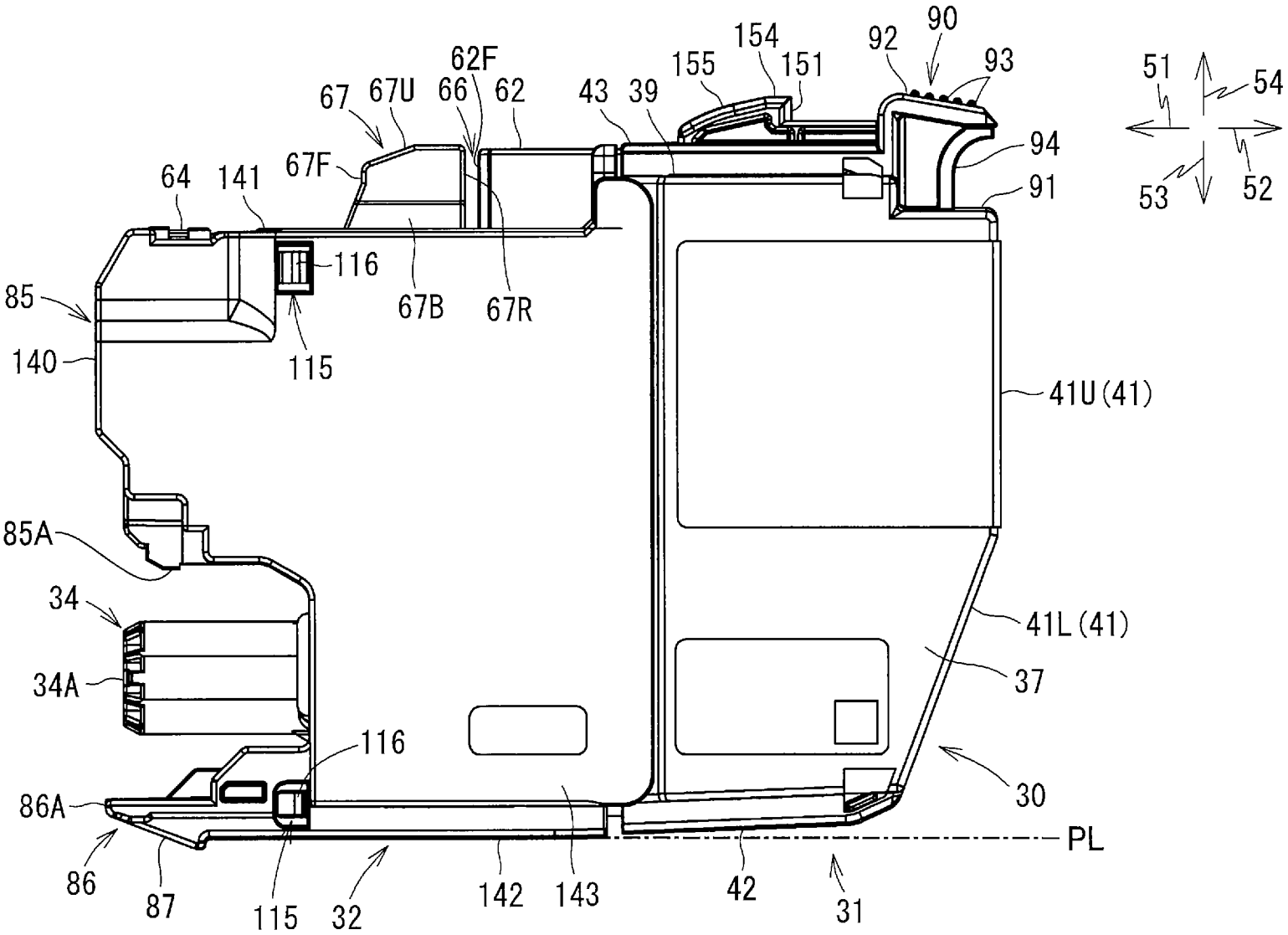
FIG. 5 is a right side view of the ink cartridge according to the embodiment.

As illustrated in FIG. 5, the rear cover 31 is positioned reward of the front cover 32 in the attached posture of the ink cartridge 30. Specifically, in the present embodiment, the rear cover 31 and front cover 32 are assembled to each other such that a rear end portion of the front cover 32 is overlapped with a front end portion (outer surface thereof) of the rear cover 31 to form a boundary between the rear cover 31 and the front cover 32 on each side surface of the ink cartridge 30. Alternatively, the front end portion of the rear cover 31 may be overlapped with the rear end portion (outer surface thereof) of the front cover 32 to form the boundary between the rear cover 31 and the front cover 32 on each side surface of the ink cartridge 30.

The rear wall 41 includes an upper portion 41U and a lower portion 41L, as illustrated in FIGS. 3A to 4B. The upper portion 41U is arranged above the lower portion 41L. The lower portion 41L is positioned frontward relative to the upper portion 41U. The upper portion 41U and the lower portion 41L are both planar shaped, and intersect each other but are not perpendicular to each other. Specifically, the lower portion 41L is inclined relative to the up-down direction 53, 54 such that the lower portion 41L extends closer to the front wall 140 toward the bottom wall 42.

As illustrated in FIG. 5, the bottom wall 42 is slanted relative to the front-rear direction 51, 52 such that a front end of the bottom wall 42 is positioned lower than a rear end of the bottom wall 42. Note that, a phantom line PL parallel to the front-rear direction 51, 52 is indicated in FIG. 5 in order to clarify the slope of the bottom wall 42 relative to the front-rear direction 51, 52. The front end of the bottom wall 42 constitutes a front end of the rear cover 31. The front end of the bottom wall 42 is positioned frontward of a locking surface 151 (described later) of the ink cartridge 30. The rear end of the bottom wall 42 is connected to a lower end of the lower portion 41L of the rear wall 41.

Figure 3A:
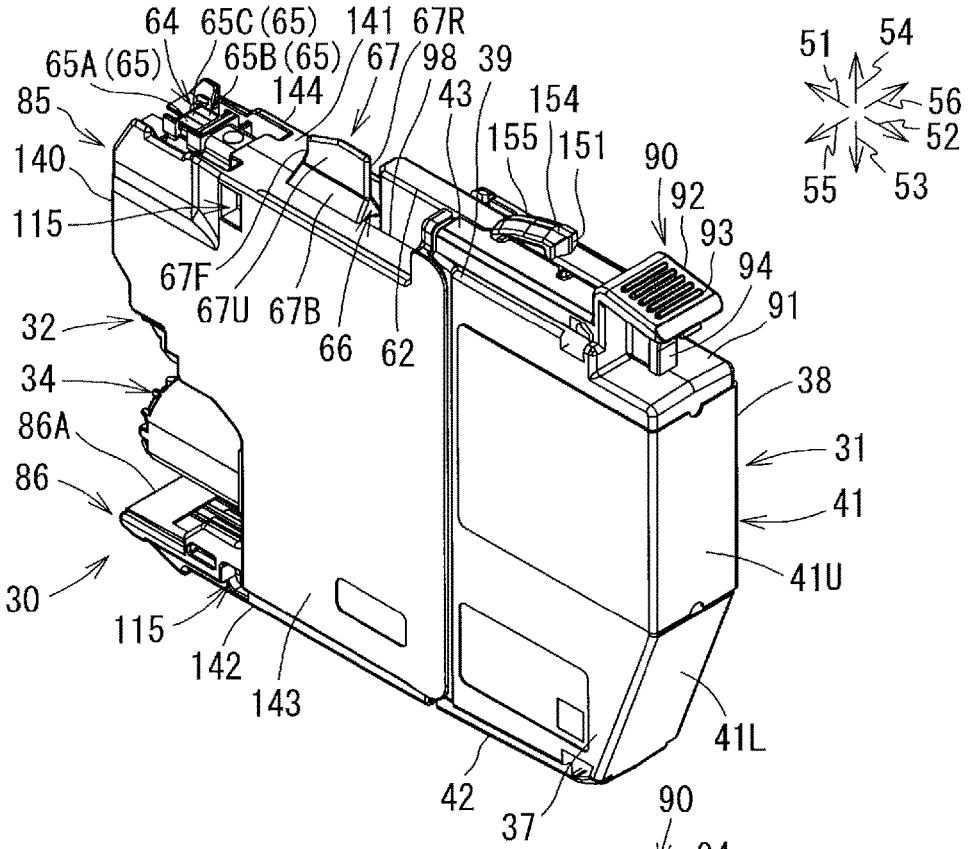
FIG. 3A is a perspective view showing an external appearance of the ink cartridge according to the embodiment when viewed from a perspective rearward and upward of the ink cartridge.
Figure 3B:
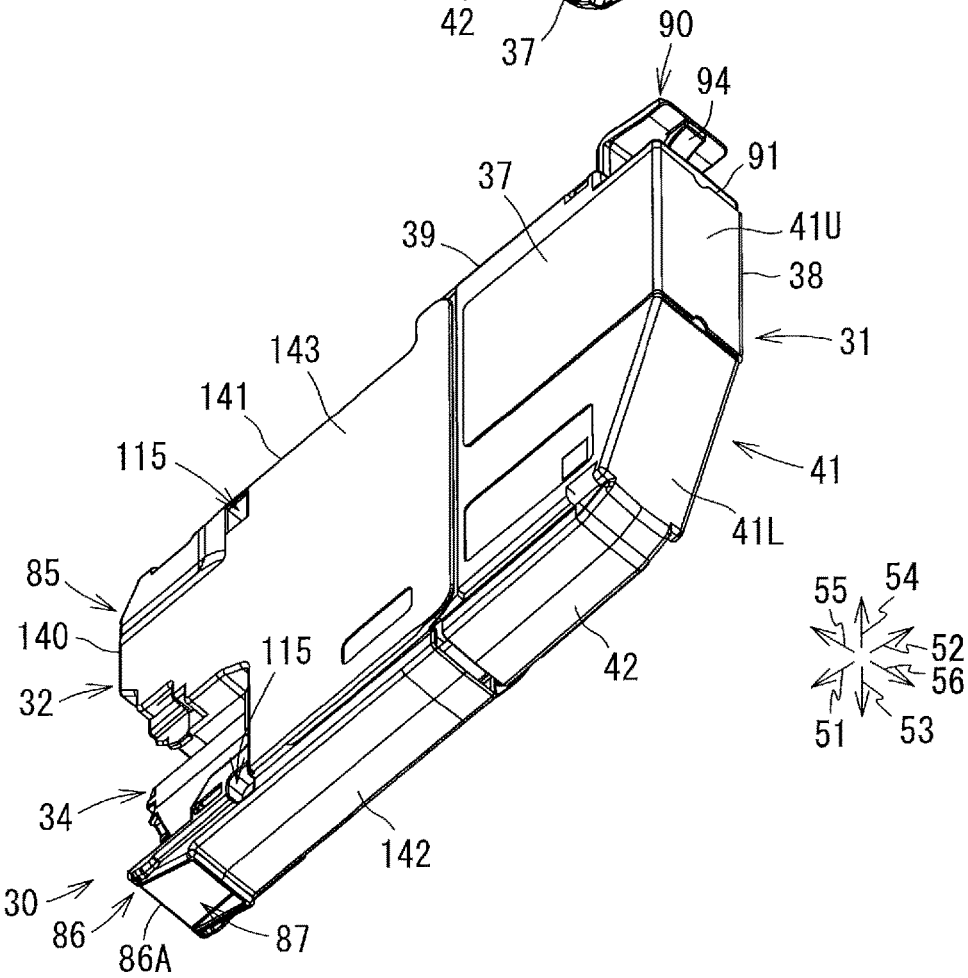
FIG. 3B is a perspective view showing the external appearance of the ink cartridge according to the embodiment when viewed from a perspective rearward and downward of the ink cartridge.
Figure 4A:
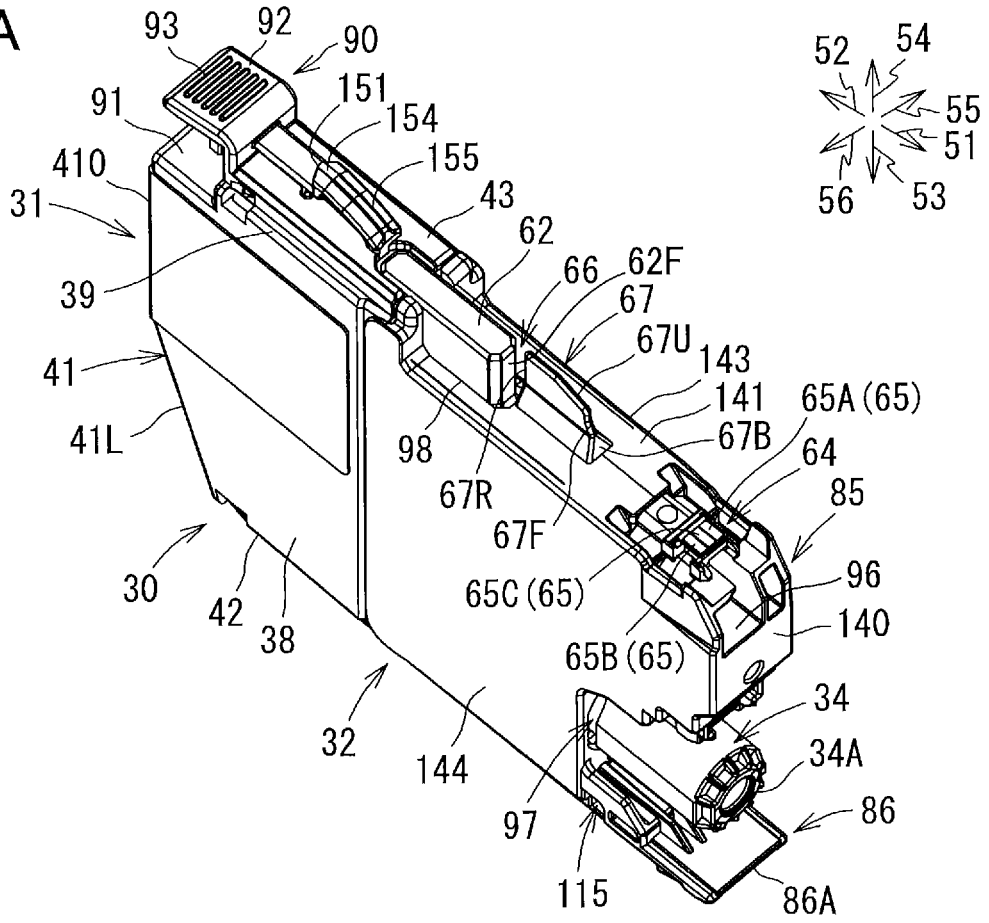
FIG. 4A is a perspective view showing the external appearance of the ink cartridge according to the embodiment when viewed from a perspective frontward and upward of the ink cartridge.
Figure 4B:
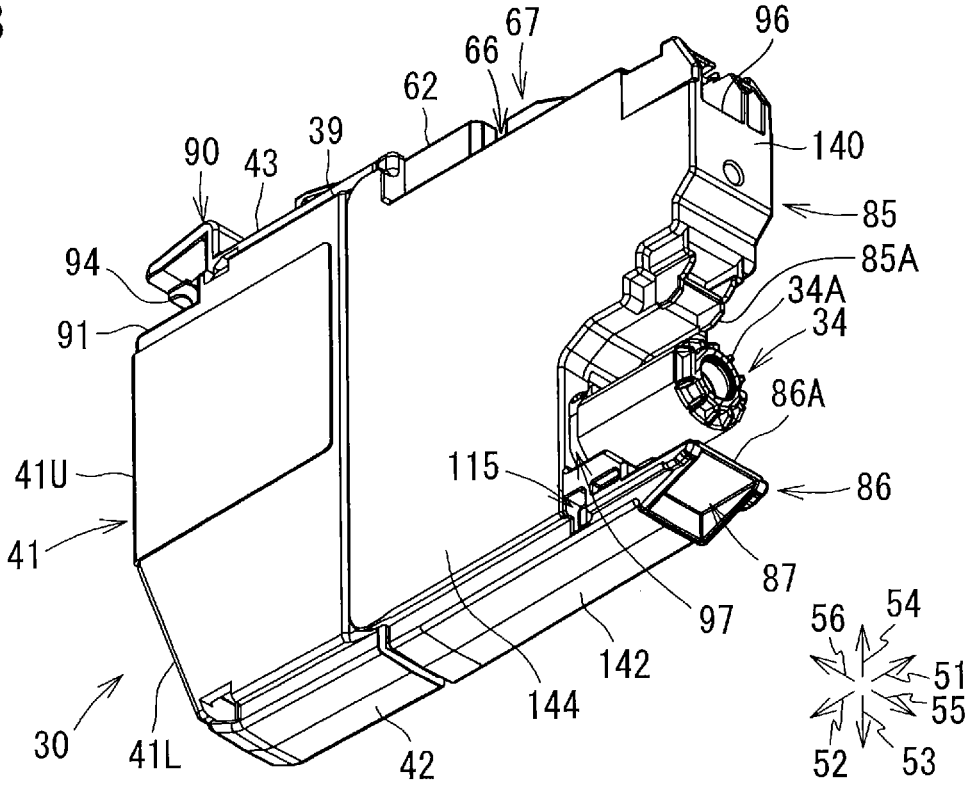
FIG. 4B is a perspective view showing the external appearance of the ink cartridge according to the embodiment when viewed from a perspective frontward and downward of the ink cartridge.

As illustrated in FIGS. 3A and 4A, a protrusion 43 is provided on an upper surface of the top wall 39 of the rear cover 31. The protrusion 43 is arranged on a center of the top wall 39 in the right-left direction 55, 56 to extend in the front-rear direction 51, 52. The protrusion 43 has a rear surface facing rearward and extending in the up-down direction 53, 54. This rear surface of the protrusion 43 functions as the locking surface 151 of the ink cartridge 30. The locking surface 151 is positioned above the bottom wall 42 of the rear cover 31. The locking surface 151 is configured to face the locking portion 145 in the rearward direction 52 and abut on the locking portion 145 in the attached state of the ink cartridge 30 to the cartridge-attachment section 110. The engagement of the locking surface 151 with the locking portion 145 enables the ink cartridge 30 to be held in the attached state in the cartridge-attachment section 110 against the rearward urging force applied from the coil spring 78.

The protrusion 43 also has a horizontal surface 154 and a sloped surface 155. The horizontal surface 154 is connected to an upper edge of the locking surface 151 to extend frontward therefrom. The horizontal surface 154 is thus positioned forward of the locking surface 151. The horizontal surface 154 is a surface extending in the front-rear direction 51, 52 and in the right-left direction 55, 56. The sloped surface 155 is connected to a front edge of the horizontal surface 154 to extend frontward therefrom. The sloped surface 155 is thus positioned frontward of the horizontal surface 154. The sloped surface 155 faces frontward and upward. In this way, the sloped surface 155 and locking surface 151 are connected to each other via the horizontal surface 154, so that a boundary edge between the locking surface 151 and inclined surface 155 does not constitute a ridge-like shape. During the insertion of the ink cartridge 30 into the cartridge-attachment section 110, the locking portion 145 is smoothly guided toward the rear beyond the locking surface 151 while making contact with and sliding along the sloped surface 155 and the horizontal surface 154.

An operation portion 90 is also provided on the upper surface of the top wall 39 of the rear cover 31. The operation portion 90 is positioned rearward of the locking surface 151. The upper surface of the top wall 39 has a rear end portion that is depressed downward from a remaining portion of the upper surface of the top wall 39. This depressed portion (rear end portion) of the upper surface of the top wall 39 serves as a sub-upper surface 91. That is, the sub-upper surface 91 is positioned lower than the remaining portion on the upper surface of the top wall 39. The operation portion 90 is disposed upward relative to the sub-upper surface 91 and is spaced apart therefrom. The operation portion 90 has a generally flat plate-like shape. Specifically, the operation portion 90 protrudes upward from a region near the boundary between the sub-upper surface 91 and the remaining portion on the upper surface of the top wall 39, extends further upward than the protrusion 43, and is then bent obliquely rearward and downward.

Figure 8:
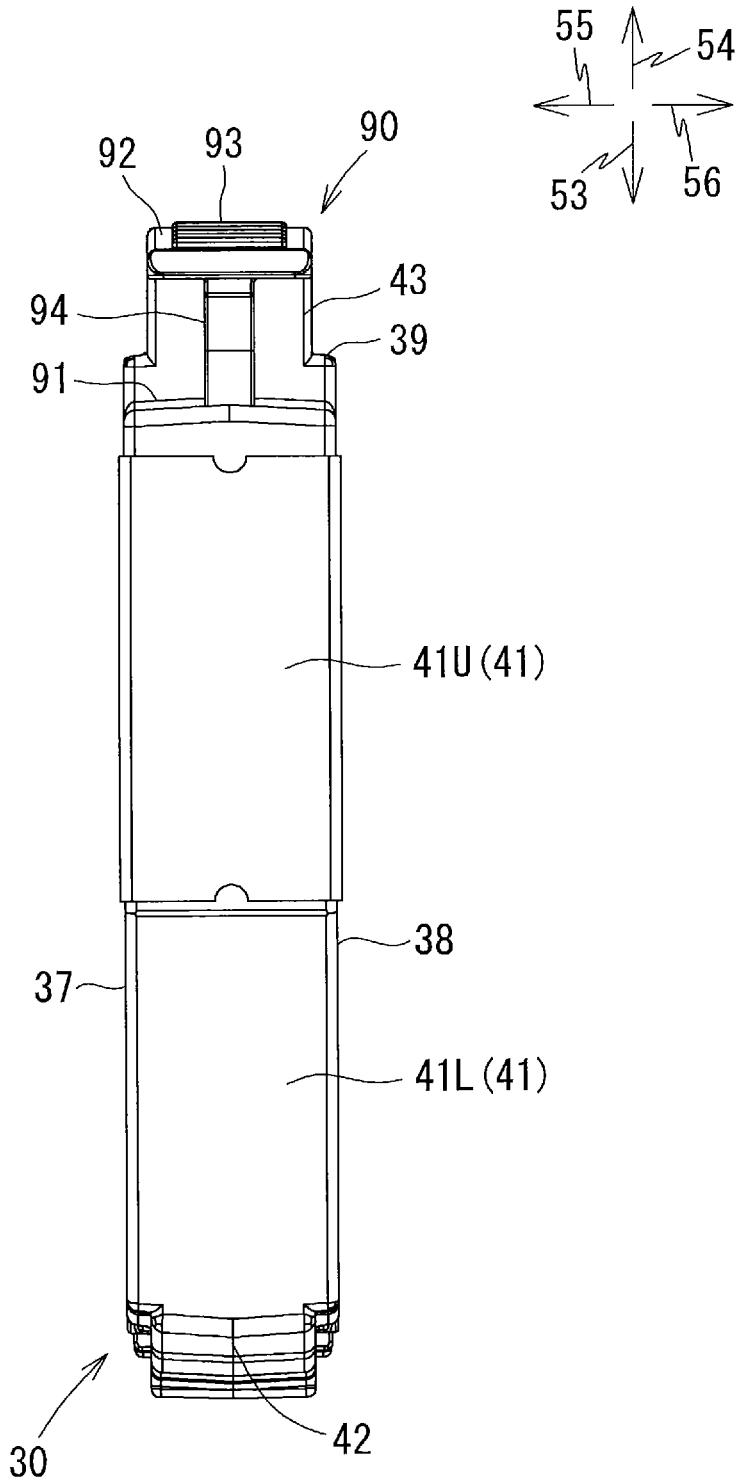
FIG. 8 is a rear view of the ink cartridge according to the embodiment.

A rib 94 is provided between the sub-upper surface 91 and the operation portion 90. The rib 94 connects the operation portion 90 to the sub-upper surface 91 in the up-down direction 53, 54, and extends in the front-rear direction 51, 52. As illustrated in FIG. 8, with respect to the right-left direction 55, 56, the rib 94 has a width that is smaller than each of a width of the sub-upper surface 91 and a width of the operation portion 90.

The operation portion 90 has an operation surface 92 facing upward and rearward. The operation surface 92 and the sub-upper surface 91 are aligned with each other at least partially in the up-down direction 53, 54. In other words, when the ink cartridge 30 is viewed from above, the operation surface 92 and the sub-upper surface 91 overlap with each other. On the operation surface 92, a plurality of ridges 93 is formed as a plurality of projections. The ridges 93 extend in the right-left direction 55, 56 and are spaced apart from one another in the front-rear direction 51, 52. These ridges 93 allow the user to easily visually recognize the operation surface 92. The ridges 93 can also serve to prevent a user's finger from slipping over the operation surface 92 when he or she operates the operation surface 92.

Figure 6:
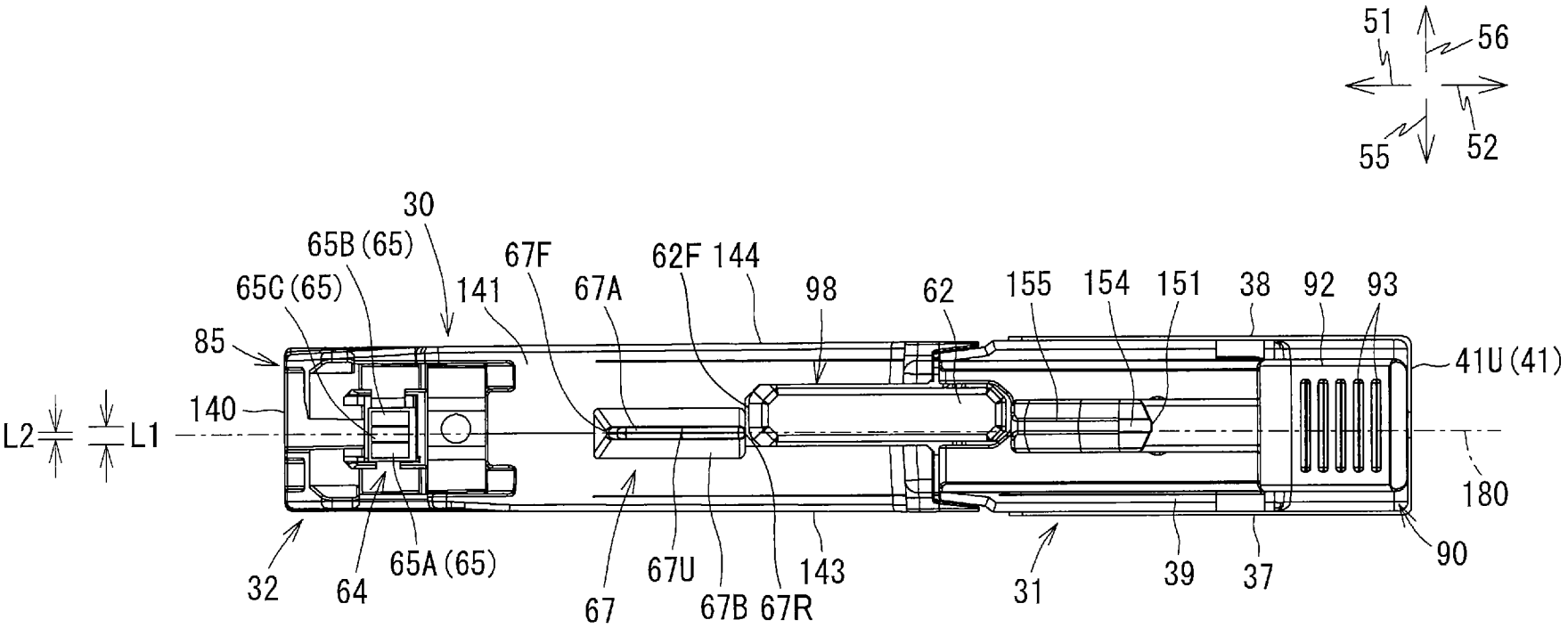
FIG. 6 is a top view of the ink cartridge according to the embodiment.
Figure 7:
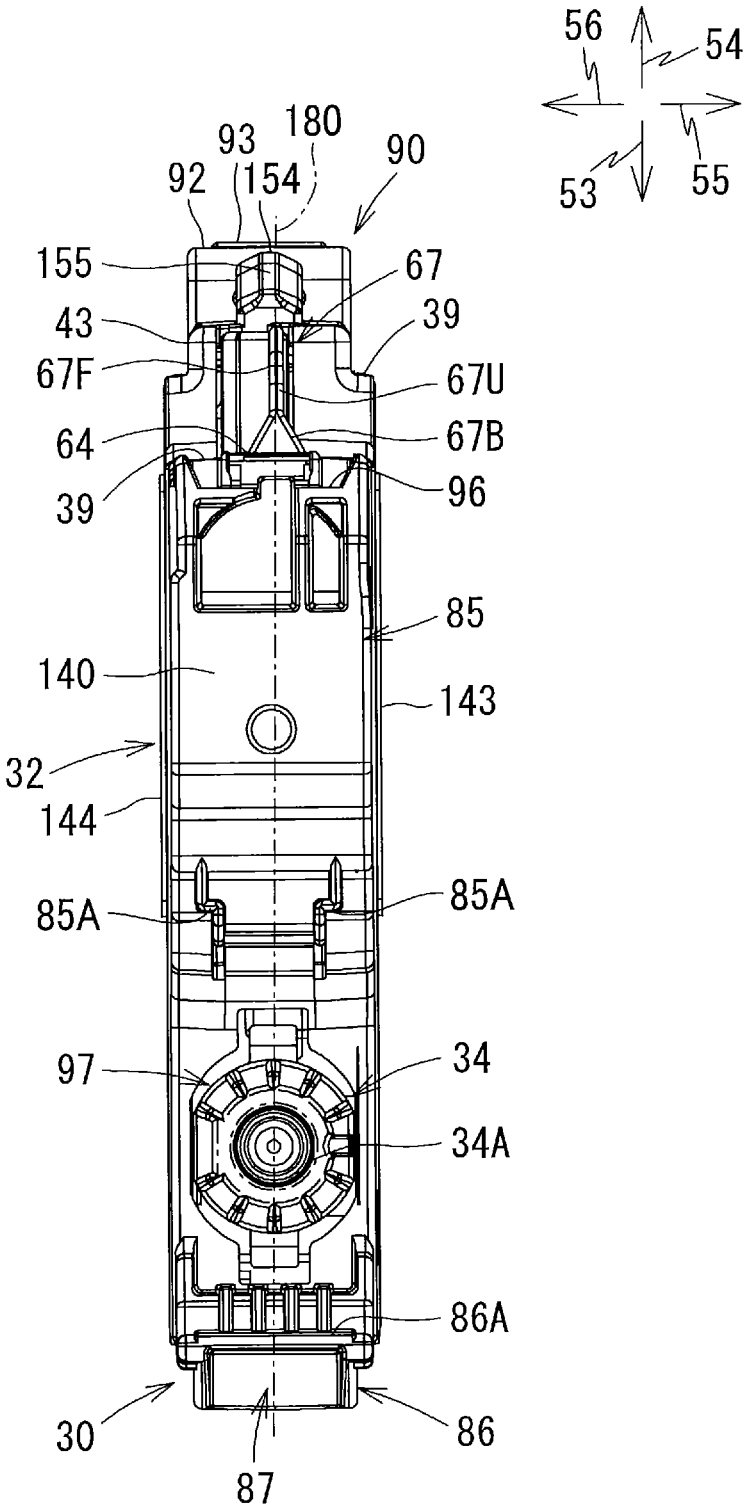
FIG. 7 is a front view of the ink cartridge according to the embodiment.

As illustrated in FIGS. 6 and 8, the operation surface 92 is visible when the ink cartridge 30 is viewed from above and rearward thereof. The user operates the operation surface 92 in an attempt to remove the ink cartridge 30 attached to the cartridge-attachment section 110 therefrom. The operation portion 90 is fixed to the rear cover 31 so as not to move relative to the rear cover 31. For example, the operation portion 90 may be formed integrally with the rear cover 31 so as not to pivot relative thereto. Thus, a force applied from the user to the operation surface 92 is directly transmitted to the rear cover 31 without changing a direction of the force. In the present embodiment, the operation portion 90 is further configured not to make any movement relative to the inner frame 35 and the ink chamber 36. That is, the operation portion 90 do not pivot relative to the inner frame 35 nor to the ink chamber 36.

<Front Cover 32>

As illustrated in FIGS. 3A to 4B, the front cover 32 includes the front wall 140, side walls 143 and 144, the top wall 141 and the bottom wall 142. The side walls 143 and 144 are spaced apart from each other in the right-left direction 55, 56. The top wall 141 and the bottom wall 142 are spaced apart from each other in the up-down direction 53, 54. The side walls 143 and 144, the top wall 141 and the bottom wall 142 extend rearward from the front wall 140. That is, the front cover 32 has a box shape formed with an opening that is open rearward. The inner frame 35 is inserted into the front cover 32 via this opening. That is, the front cover 32 covers a front portion of the inner frame 35 that is not covered by the rear cover 31.

In a state where the front cover 32 and the rear cover 31 are assembled to each other, that is, in a state where assembly of the ink cartridge 30 is completed, the top wall 141 of the front cover 32 and the top wall 39 of the rear cover 31 constitute a top wall of the ink cartridge 30; the bottom wall 142 of the front cover 32 and the bottom wall 42 of the rear cover 31 constitute a bottom wall of the ink cartridge 30; and the side walls 143 and 144 of the front cover 32 and the side walls 37 and 38 of the rear cover 31 respectively constitute side walls of the ink cartridge 30.

Hence, in the assembled ink cartridge 30, a top surface of the top wall 141 and the top surface of the top wall 39 constitute a top surface of the ink cartridge 30; a bottom surface of the bottom wall 142 and a bottom surface of the bottom wall 42 constitute a bottom surface of the ink cartridge 30; and outer surfaces of the side walls 143 and 144 and outer surfaces of the side walls 37 and 38 constitute respective side surfaces of the ink cartridge 30.

In the attached posture of the ink cartridge 30, the bottom wall 142 of the front cover 32 extends in the front-rear direction 51, 52, and the bottom wall 42 of the rear cover 31 is sloped to face downward and rearward.

Further, in the state where the ink cartridge 30 is assembled, the front wall 140 of the front cover 32 constitutes a front wall of the ink cartridge 30, whereas the rear wall 41 of the rear cover 31 constitutes a rear wall of the ink cartridge 30. The front wall of the ink cartridge 30 (front wall 140 of the front cover 32) and the rear wall of the ink cartridge 30 (rear wall 41 of the rear cover 31) are arranged to be spaced apart from each other in the front-rear direction 51, 52. That is, in the attached posture, a front surface of the front wall 140 constitutes a front surface of the ink cartridge 30; and a rear surface of the rear wall 41 constitutes a rear surface of the ink cartridge 30.

Incidentally, the front surface, rear surface, top surface, bottom surface, and side surfaces constituting the ink cartridge 30 need not be configured as one flat plane, respectively. That is, the front surface of the ink cartridge 30 can be any surface(s) that can be seen when the ink cartridge 30 in its attached posture is viewed from its front side, and that is(are) positioned frontward relative to a center of the ink cartridge 30 in the front-rear direction 51, 52. The rear surface of the ink cartridge 30 can be any surface(s) that can be seen when the ink cartridge 30 in its attached posture is viewed from its rear side, and that is(are) positioned rearward relative to the center of the ink cartridge 30 in the front-rear direction 51, 52. The top surface of the ink cartridge 30 can be any surface(s) that can be seen when the ink cartridge 30 in its attached posture is viewed from above, and that is(are) positioned upward relative to a center of the ink cartridge 30 in the up-down direction 53, 54. The bottom surface of the ink cartridge 30 can be any surface(s) that can be seen when the ink cartridge 30 in its attached posture is viewed from below, and that is(are) positioned downward relative to the center of the ink cartridge 30 in the up-down direction 53, 54. The same is applied to the side surfaces of the ink cartridge 30.

A through-hole 97 is formed in a lower end portion of the front wall 140 to penetrate the same in the front-rear direction 51, 52. When the inner frame 35 is inserted in the front cover 32, the ink supply portion 34 provided at the inner frame 35 is exposed outside through the through-hole 97. Accordingly, the through-hole 97 is formed at a position, with a size and a shape corresponding to those of the ink supply portion 34 of the inner frame 35.

A first protruding portion 85 and a second protruding portion 86 are formed on the front surface of the front wall 140. The first protruding portion 85 protrudes frontward from an upper end portion of the front cover 32 to constitute an upper end portion of the front wall 140. The first protruding portion 85 has a front end constituting a part of the front surface of the front wall 140. A recess 96 is formed on the front end portion of the first protruding portion 85.

The second protruding portion 86 protrudes frontward from a lower end portion of the front cover 32 to constitute a lower end portion of the front wall 140. The second protruding portion 86 is positioned below the ink supply portion 34. The second protruding portion 86 has a front end 86A that is positioned frontward of a front end 34A of the ink supply potion 34. In the present embodiment, the second protruding portion 86 has a tray-like shape as illustrated in FIGS. 3A to 4B. Since the front end 86A protrudes further forward relative to the front end 34A of the ink supply potion 34, the second protruding portion 86 can serve to receive ink droplets which may be trickled down accidentally from the ink supply port 71 at the front end 34A of the ink supply potion 34.

On a lower end portion of the front end 86A, a recess 87 is formed to open downward and frontward. A portion of the recess 87 protrudes further downward relative to the bottom surface of the bottom wall 142 of the front cover 32 (see FIG. 9).

Further, a through-hole 98 is formed in the top wall 141 of the front cover 32 (see FIGS. 3A, 4A and 6). The through-hole 98 penetrates the top wall 141 in the up-down direction 53, 54. The through-hole 98 serves as a hole for exposing the detection portion 62 (described later) of the inner frame 35 to the outside in a state where the inner frame 35 is inserted in the front cover 32. Accordingly, the through-hole 98 is formed in the top wall 141 at a position, with a size and a shape corresponding to those of the detection portion 62 of the inner frame 35.

A light-blocking plate 67 is provided at the top wall 141 (top surface of the top wall 141) of the front cover 32 to protrude upward therefrom. The light-blocking plate 67 extends in the front-rear direction 51, 52. The light-blocking plate 67 is positioned frontward of the detection portion 62 of the inner frame 35. The light-blocking plate 67 includes an upper portion 67U, and a lower portion 67B positioned below the upper portion 67U. The upper portion 67U has a flat plate-like shape whose width in the right-left direction 55, 56 is constant across an entire length thereof in the front-rear direction 51, 52. The lower portion 67B has a tapered shape in a front view having a width in the right-left direction 55, 56 that becomes greater toward the bottom. In other words, the width of the lower portion 67B in the right-left direction 55, 56 becomes narrower toward the upper portion 67U (as extending away from the upper surface of the top wall 141).

The light-blocking plate 67 has a front edge 67F and a rear edge 67R. As best shown in FIG. 5, a space 66 is provided between the rear edge 67R of the light-blocking plate 67 and a front edge 62F of the detection portion 62 in the front-rear direction 51, 52. The space 66 is a gap in the front-rear direction 51, 52 between the rear edge 67R of the light-blocking plate 67 and the front edge 62F of the detection portion 62. That is, in a side view, the light-blocking plate 67 and detection portion 62 are aligned with each other in the front-rear direction 51, 52 via the space 66. The space 66 provides fluid communication in the right-left direction 55, 56. The light-blocking plate 67 is positioned rearward and upward relative to an IC board 64 (described later) provided on the top wall 141.

The upper portion 67U of the light-blocking plate 67 is configured to block the light of the of the sensor 103 traveling in the right-left direction 55, 56. More specifically, when the ink cartridge 30 is attached to the cartridge-attachment section 110, the light emitted from the light-emitting element of the sensor 103 is incident on the upper portion 67U of the light-blocking plate 67 before arriving at the light-receiving element. As a result, the intensity of light received at the light-receiving element is less than a predetermined intensity, for example, zero. Note that the upper portion 67U of the light-blocking plate 67 may completely block the light traveling in the right-left direction 55, 56, or may partially attenuate the light, may refract the light to change a traveling direction thereof, or may fully reflect the light. A portion of the upper portion 67U functions as a light-blocking portion when partially blocks or attenuates the light.

The IC board 64 is provided on the upper surface of the top wall 141 at a position above the first protruding portion 85, i.e., above the ink supply potion 34. The IC board 64 is configured to be electrically connected to the corresponding three contacts 106 arranged in the right-left direction 55, 56 during the insertion of the ink cartridge 30 into the cartridge-attachment section 110, as well as upon completion of the attachment of the ink cartridge 30 to the cartridge-attachment section 110.

On the IC board 64, an IC (not illustrated) and the electrode group 65 are mounted. The IC is a semiconductor integrated circuit and readably stores data indicating information on the ink cartridge 30, such as a lot number, a production date, and a color of the ink. The IC is mounted on a rigid substrate made of a glass epoxy, for example.

The electrode group 65 is formed on an upper surface of the rigid substrate so that the electrode group 65 is electrically accessible from the outside. The electrode group 65 is electrically connected to the IC. In the attached state of the ink cartridge 30 to the cartridge-attachment section 110, power is supplied to the IC through the contacts 106 and the electrode group 65. Specifically, the electrode group 65 of the embodiment consists of the power-supply electrode 65A for power supply, the signal electrode 65B for exchanging signals, and the grounding electrode 65C for grounding. Each of these electrodes 65A, 65B, 65C extends in the front-rear direction 51, 52. The three electrodes 65A, 65B, 65C are arranged to be spaced apart from each other in the right-left direction 55, 56.

Among the three electrodes 65A, 65B, 65C, the grounding electrode 65C is positioned center in the right-left direction 55, 56. That is, the grounding electrode 65C is positioned between the power-supply electrode 65A and the signal electrode 65B in the right-left direction 55, 56. Specifically, in the present embodiment, the power-supply electrode 65A is positioned on the right of the grounding electrode 65C, and the signal electrode 65B is positioned on the left of the grounding electrode 65C. However, the arrangement of the power-supply electrode 65A and signal electrode 65B with respect to the grounding electrode 65C may be interchangeable in the right-left direction 55, 56. That is, the power-supply electrode 65A may be positioned on the left of the grounding electrode 65C, and the signal electrode 65B may be positioned on the right of the grounding electrode 65C. The power-supply electrode 65A and signal electrode 65B are electrically connected to each other.

<Inner Frame 35>

Although not illustrated in the drawings, the inner frame 35 has a generally annular shape, with a pair of side surfaces in the right-left direction 55, 56 opened. The respective open surfaces of the inner frame 35 are sealed with films (not shown) to form the ink chamber 36 for storing ink in the inner frame 35. The inner frame 35 includes a front wall 40 that faces the front wall 140 of the front cover 32 when the inner frame 35 is accommodated in the front cover 32. More specifically, a front surface of the front wall 40 faces a rear surface (opposite the front surface) of the front wall 140 when the inner frame 35 is accommodated in the front cover 32. The ink supply portion 34 is disposed at the front wall 40.

The rear cover 31 is fixed to the inner frame 35. The front cover 32 is movable in the front-rear direction 51, 52 and up-down direction 53, 54 relative to the inner frame 35.

As illustrated in FIGS. 3A to 5, openings 115 are formed in the respective side walls 143 and 144 of the front cover 32. Specifically, each of the side walls 143, 144 has two openings 115. The inner frame 35 includes protrusions 116 each at a position corresponding to one of the openings 115. The protrusions 116 protrude outward in the right-left direction 55, 56 so that the protrusions 116 are received in the respective openings 115. Dimensions of each opening 115 in the front-rear direction 51, 52 and in the up-down direction 53, 54 are greater than dimensions of the corresponding protrusion 116 in the front-rear direction 51, 52 and in the up-down direction 53, 54, respectively. Since the protrusions 116 move inside the corresponding openings 115 in the front-rear direction 51, 52, the front cover 32 is movable in the front-rear direction 51, 52 relative to the inner frame 35. Further, the front cover 32 is movable in the up-down direction 53, 54 relative to the inner frame 35, since the protrusions 116 move inside the corresponding openings 115 in the up-down direction 53, 54.

<Ink Supply Portion 34>

Figure 9:
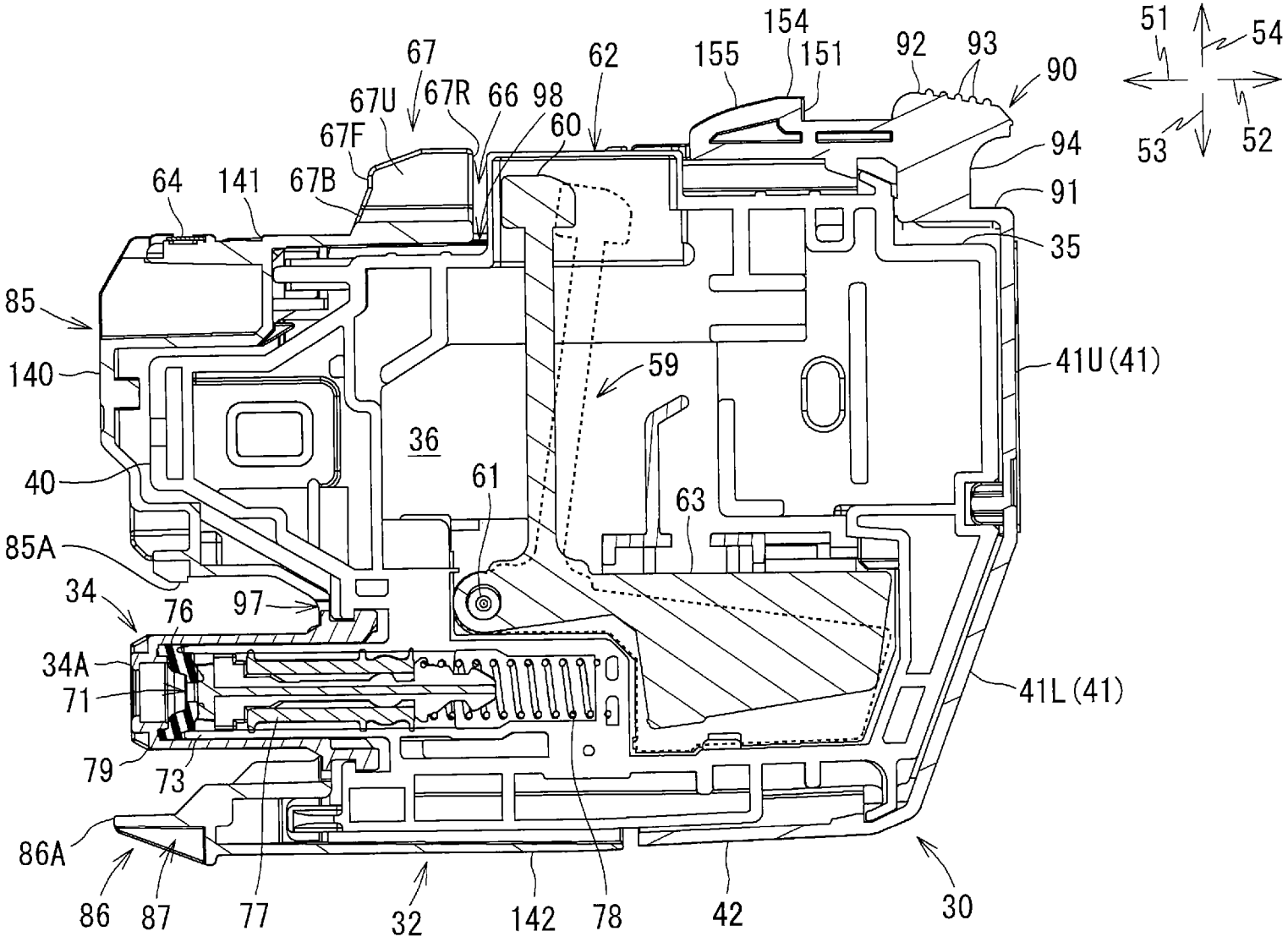
FIG. 9 is a vertical cross-sectional view illustrating an internal configuration of the ink cartridge according to the embodiment.

As shown in FIG. 9, the ink supply portion 34 protrudes frontward from the front wall 40 of the inner frame 35. The ink supply portion 34 has a cylindrical outer shape, and extends in the front-rear direction 51, 52. The ink supply potion 34 protrudes outward (frontward) through the through-hole 97 formed in the front wall 140 of the front cover 32 in the state where the inner frame 35 is accommodated in the front cover 32. That is, the ink supply portion 34 is positioned at a lower end portion of the front wall 140.

The ink supply portion 34 includes a cylindrical-shaped tubular wall 73 defining an internal space therein, a sealing member 76, and a cap 79. The sealing member 76 and cap 79 are attached to the tubular wall 73.

The tubular wall 73 extends to connect the interior and exterior of the ink chamber 36. The tubular wall 73 has a rear end that is opened in the ink chamber 36. The tubular wall 73 has a front end that is opened to the outside of the ink cartridge 30. Accordingly, the tubular wall 73 provides fluid communication between the ink chamber 36 and the outside of the ink cartridge 30 through the internal space of the tubular wall 73. The ink supply portion 34 can thus supply the ink stored in the ink chamber 36 to the outside of the ink cartridge 30 via the internal space of the tubular wall 73. The sealing member 76 and the cap 79 are attached to the front end of the tubular wall 73.

In the internal space of the tubular wall 73, a valve 77 and the coil spring 78 are accommodated. The valve 77 and the coil spring 78 serve to selectively switch states of the ink supply portion 34 between a state shown in FIG. 12 and a state shown in FIG. 9. That is, in the state shown in FIG. 12, the ink is allowed to flow out of the ink chamber 36 to the outside of the ink cartridge 30 via the internal space of the tubular wall 73. In the state shown in FIG. 9, the ink is not allowed to flow out of the internal space of the tubular wall 73 to the outside of the ink cartridge 30.

The valve 77 is movable in the front-rear direction 51, 52 to open and close the ink supply port 71 formed at a center of the sealing member 76. The coil spring 78 urges the valve 77 frontward. Accordingly, without application of an external force, the valve 77 closes off the ink supply port 71 of the sealing member 76.

The sealing member 76 is provided at the front end of the tubular wall 73. The sealing member 76 is formed of an elastic material such as rubber or elastomer. The sealing member 76 is a disc-like shaped and has a center portion in which a through-hole is formed. The through-hole penetrates through the center portion of the sealing member 76 in the front-rear direction 51, 52 to provide a tubular-shaped inner circumferential surface that defines the ink supply port 71. The ink supply port 71 has a diameter that is slightly smaller than an outer diameter of the ink needle 102. The cap 79 is externally fitted to the tubular wall 73, with the sealing member 76 attached to the front end of the tubular wall 73, so that the sealing member 76 is in liquid-tight contact with the front end of the tubular wall 73.

As the ink cartridge 30 is inserted into the cartridge-attachment section 110 in a state where the valve 77 closes the ink supply port 71, the ink needle 102 enters into the ink supply port 71. An outer circumferential surface of the ink needle 102 is brought into contact with the inner circumferential surface defining the ink supply port 71 to provide a liquid-tight seal therewith, while elastically deforming the sealing member 76. When a tip end portion of the ink needle 102 moves past the sealing member 76 and enters into the internal space of the tubular wall 73, the ink needle 102 comes in contact with the valve 77. As the ink cartridge 30 is further inserted into the cartridge-attachment section 110, the ink needle 102 moves the valve 77 rearward against the urging force of the coil spring 78, thereby opening the ink supply port 71. Accordingly, the ink stored in the ink chamber 36 can flow into the tip end portion of the ink needle 102 via the internal space of the tubular wall 73. Although not illustrated in the drawings, through-holes are formed in the tip end portion of the ink needle 102. Through these through-holes of the ink needle 102, the ink is allowed to flow from the internal space of the tubular wall 73 into an internal space of the ink needle 102. In this way, the ink stored in the ink chamber 36 can flow outside the ink cartridge 30 through the internal spaces of the tubular wall 73 and the ink needle 102.

Incidentally, the ink supply portion 34 may not be provided with the valve 77 for closing the ink supply port 71. Instead, for example, the ink supply port 71 may be closed with a film. In this case, the ink needle 102 may break through the film at the time of insertion of the ink cartridge 30 into the cartridge-attachment section 110, thereby allowing the tip end portion of the ink needle 102 to enter inside the internal space of the tubular wall 73 through the ink supply port 71. Still alternatively, the ink supply port 71 may be closed with an elastic force of the sealing member 76 itself. In this case, the ink supply port 71 may be pushed and enlarged by the ink needle 102 only when the ink needle 102 is inserted in the ink supply port 71.

<Detection Portion 62>

As illustrated in FIG. 9, the detection portion 62 is provided on an upper wall of the inner frame 35 to protrude upward therefrom. The detection portion 62 is exposed to the outside through the through-hole 98 formed in the front cover 32 such that the detection portion 62 protrudes upward relative to the top wall 141 of the front cover 32. The detection portion 62 defines an internal space herein that is in communication with the ink chamber 36. The detection portion 62 can allow light to pass therethrough in the right-left direction 55, 56. That is, the detection portion 62 has light-transmissive properties.

A sensor arm 59 is disposed inside the ink chamber 36 of the inner frame 35. The sensor arm 59 is supported by a pivot shaft 61 extending in the right-left direction 55, 56. The sensor arm 59 is pivotably movable about the pivot shaft 61. The sensor arm 59 includes a float 63 and a light-blocking plate 60.

The float 63 has a specific gravity smaller than a specific gravity of the ink stored in the ink chamber 36. Accordingly, in the ink chamber 36, buoyancy is generated on the float 63 as long as the float 63 is in the ink. In other words, in a state where the ink chamber 36 is almost filled with the ink, the sensor arm 59 is urged to pivot counterclockwise in FIG. 9 due to the buoyancy generated on the float 63.

The light-blocking plate 60 is plate-shaped and is disposed inside the detection portion 62 of the inner frame 35. Since the sensor arm 59 is urged to pivot counterclockwise in FIG. 9, the light-blocking plate 60 is in contact with a wall defining the front edge 67F of the detection portion 62. Due to this contact, the sensor arm 59 is maintained in a posture depicted in FIG. 9. In this posture of the sensor arm 59 shown in FIG. 9, the light-blocking plate 60 is at a first position where the light-blocking plate 60 blocks the light from the sensor 103 traveling in the right-left direction 55, 56 through the detection portion 62. At the first position, the second light-blocking plate 60 is located higher relative to the top wall 141 of the front cover 32.

More specifically, when the light emitted from the light-emitting element of the sensor 103 is incident on the light-blocking plate 60 (a side surface thereof) before arriving at the light-receiving element, the intensity of the light received at the light-receiving element is less than a predetermined intensity, for example, zero. Note that the light-blocking plate 60 may completely block the light traveling in the right-left direction 55, 56, or may partially attenuate the light, or may totally reflect the light. Still alternatively, the light-blocking plate 60 may be configured as a prism, for example, for refracting the light to change a traveling direction thereof.

When the amount of ink decreases in the ink chamber 36 and a liquid surface of the ink becomes lower than the position of the float 63 depicted in FIG. 9 (the position of the float 63 when the sensor arm 59 is in the posture depicted in FIG. 9 to provide the light-blocking plate 60 at the first position), the float 63 starts to move downward, following the declining liquid surface of the ink. In accordance with the downward movement of the float 63, the sensor arm 59 is pivoted clockwise in FIG. 9, thereby moving a part of the light-blocking plate 60 located inside the detection portion 62 (at the first position) downward to a second position where the light-blocking plate 60 is out of an optical path formed by the light traveling from the light-emitting element to the light-receiving element of the sensor 103. Accordingly, the intensity of the light received at the light-receiving element of the sensor 103 is equal to or greater than the predetermined intensity when the light-blocking plate 60 is at the second position.

In this way, in the present embodiment, the detection portion 62 and light-blocking plate 60 located inside the detection portion 62 in combination can allow the sensor 103 to detect the residual amount of the ink in the ink chamber 36 in the attached state of the ink cartridge 30 to the cartridge-attachment section 110.

<Arrangement of the Detection Portion 62, Electrode Group 65, and Light-Blocking Plate 67>

As illustrated in FIG. 6, the detection portion 62, IC board 64 and light-blocking plate 67 are positioned at the top surface of the top wall 141 of the front cover 32. To be precise, the detection portion 62 penetrates the through-hole 98 of the top wall 141 of the front cover 32 to protrude upward relative to the top surface of the top wall 141. In the present disclosure, this structure of the detection portion 62 relative to the top wall 141 will be defined as a state where the detection portion 62 is provided at the top wall 141.

Referring to FIG. 6, the upper portion 67U of the light-blocking plate 67 and the grounding electrode 65C are arranged at the top wall 141 of the front cover 32 such that the upper portion 67U and the grounding electrode 65C are positioned on a datum plane 180 which is indicated by a phantom line in FIG. 6. The datum plane 180 extends in parallel to the front-rear direction 51, 52 and the up-down direction 53, 54. The datum plane 180 passes through a center of the front cover 32 in the right-left direction 55, 56. Accordingly, a widthwise center of the upper portion 67U in the right-left direction 55, 56 is coincident with the center of the front cover 32 in the right-left direction 55, 56. Further, referring to FIG. 7, the datum plane 180 passes through a center of the ink supply potion 34 (a center of the front end 34A of the ink supply potion 34). That is, the datum plane 180 passes through a center of the ink supply port 71.

A widthwise center of the grounding electrode 65C in the right-left direction 55, 56 is also positioned on the datum plane 180. The grounding electrode 65C has a width L in the right-left direction 55, 56 greater than a width L2 of a top surface 67A of the light-blocking plate 67 (i.e., a top surface of the upper portion 67U) in the right-left direction 55, 56 (L1>L2).

<Attachment/Detachment of the Ink Cartridge 30 Relative to the Cartridge-Attachment Section 110>

Next, a process for attaching the ink cartridge 30 to the cartridge-attachment section 110 will be described.

As illustrated in FIG. 9, in the ink cartridge 30 before insertion thereof into the cartridge-attachment section 110, the valve 77 closes off the ink supply port 71 of the sealing member 76. Accordingly, at this time, ink flow from the ink chamber 36 to the outside of the ink cartridge 30 is interrupted.

Also, prior to attachment of the ink cartridge 30 to the cartridge-attachment section 110, nothing is located between the light-emitting element and the light-receiving element of the sensor 103. The sensor 103 therefore outputs a high-level signal to the controller 130 of the printer 10. At this time, a cover (not illustrated) of the printer 10 is opened by a user, so that the opening 112 of the cartridge-attachment section 110 is exposed to the outside.

For attaching the ink cartridge 30 to the cartridge-attachment section 110, the ink cartridge 30 is inserted frontward into the case 101 of the cartridge-attachment section 110 through the opening 112, as shown in FIG. 10. Since the upper portion 41U of the rear wall 41 of the rear cover 31 is positioned rearward relative to the lower portion 41L of the rear wall 41, that is, since the upper portion 41U is positioned closer to the user than the lower portion 41L is to the user, the user can push the upper portion 41U to insert the ink cartridge 30 frontward into the cartridge-attachment section 110.

At the time of insertion of the ink cartridge 30 into the case 101 of the cartridge-attachment section 110, a lower portion of the ink cartridge 30, that is, lower portions of the front cover 32 and the rear cover 31, are inserted into the corresponding lower guide groove 109 formed in the bottom wall of the case 101.

As the light-blocking plate 67 is inserted further frontward, the light-blocking plate 67 comes to a location between the light-emitting element and the light-receiving element of the sensor 103. When the front edge 67F of the light-blocking plate 67 moves past the optical path of the sensor 103, the sensor 103 outputs a low-level signal, instead of the high-level signal, to the controller 130 of the printer 10. That is, the signal outputted from the sensor 103 is changed from high level to low level.

As illustrated in FIG. 11, as the ink cartridge 30 is inserted further frontward, the space 66 comes to the location between the light-emitting element and the light-receiving element of the sensor 103. When the rear edge 67R of the light-blocking plate 67 moves past the optical path of the sensor 103, the sensor 103 outputs a high-level signal, instead of the low-level signal, to the controller 130 of the printer 10. That is, the signal outputted from the sensor 103 is changed from low level to high level.

Further, as illustrated in FIG. 11, in accordance with the forward movement of the ink cartridge 30 into the cartridge-attachment section 110, the cap 79 of the ink supply portion 34 starts entering into the guide portion 105. As the cap 79 of the ink supply portion 34 enters into the guide portion 105 and the ink needle 102 moves past the ink supply port 71, the valve 77 is separated from the sealing member 76 against the urging force of the coil spring 78. The ink supply potion 34 is thus fixed in position relative to the cartridge-attachment section 110. The ink cartridge 30 is applied with the urging force of the coil spring 78 to be urged rearward.

Further, at this time, a bottom surface 85A of the first protruding portion 85 is supported by a surface 170 constituting the case 101 of the cartridge-attachment section 110, the surface 170 facing upward and being positioned above the corresponding guide portion 105 (also see FIG. 2). Due to this contact between the bottom surface 85A and the surface 170, the ink cartridge 30 is fixed in position in the up-down direction 53, 54. Incidentally, the bottom surface 85A is arranged to overlap with the IC board 64 when the ink cartridge 30 is viewed from above.

Also, at this time, the IC board 64 arrives at a position below the contacts 106. The respective electrodes 65A-65C of the electrode group 65 on the IC board 64 are thus electrically connected to the corresponding contacts 106 while resiliently deforming the contacts 106 upwardly.

Further, in the state shown in FIG. 11, the protrusion 43 of the rear cover 31 arrives at the locking portion 145 of the cartridge-attachment section 110. The sloped surface 155 of the protrusion 43 moves forward while making sliding contact with the locking portion 145, as the ink cartridge 30 moves forward. This contact between the sloped surface 155 and the locking portion 145 causes the ink cartridge 30 to pivot clockwise in FIG. 11 against a counterclockwise rotational moment that is applied to the ink cartridge 30 as a result of user's pushing of the upper portion 41U. Specifically, the ink cartridge 30 is pivoted clockwise in FIG. 11 about the center of the ink supply port 71 of the sealing member 76 in which the ink needle 102 is inserted, that is, about a center of a portion of the outer circumferential surface of the ink needle 102, the portion being in contact with the inner circumferential surface defining the ink supply port 71.

Since the bottom wall 42 of the rear cover 31 is sloped relative to the front-rear direction 51, 52, a space is available between the bottom wall 42 and the bottom wall of the cartridge-attachment section 110. This space between the bottom wall 42 and the bottom wall of the cartridge-attachment section 110 enables the ink cartridge 30 to make the above-described pivotal movement (the pivoting in a clockwise direction in FIG. 11).

As the ink cartridge 30 is inserted further frontward against the urging force of the coil spring 78 from the state shown in FIG. 11, the sloped surface 155 and horizontal surface 154 come to a location frontward of the locking portion 145, i.e., closer to the end wall of the case 101 than the locking portion 145 is to the end wall. Since the sloped surface 155 and horizontal surface 154 are now separated from the locking portion 145, the ink cartridge 30 is pivoted counterclockwise (upward) in FIG. 12 about the center of the ink supply port 71 due to the counterclockwise rotational moment applied to the ink cartridge 30 by the user's forward pushing of the upper portion 41U of the ink cartridge 30.

As a result, the locking surface 151 of the protrusion 43 now faces the locking portion 145 rearward. When the user stops pushing the ink cartridge 30 forward at this time, the ink cartridge 30 is moved rearward by the urging force of the coil spring 78. In response to the rearward movement of the ink cartridge 30, the locking surface 151 comes into contact with the locking portion 145 from frontward thereof. As a result of this contact of the locking surface 151 with the locking portion 145, the ink cartridge 30 is restricted from moving further rearward in the cartridge-attachment section 110 to complete the attachment of the ink cartridge 30 to the cartridge-attachment section 110. The ink cartridge 30 is thus fixed in position relative to the cartridge-attachment section 110. In the attached state of the ink cartridge 30, the detection portion 62 (and the light-blocking plate 60) is positioned on the optical path of the sensor 103.

Figure 13:
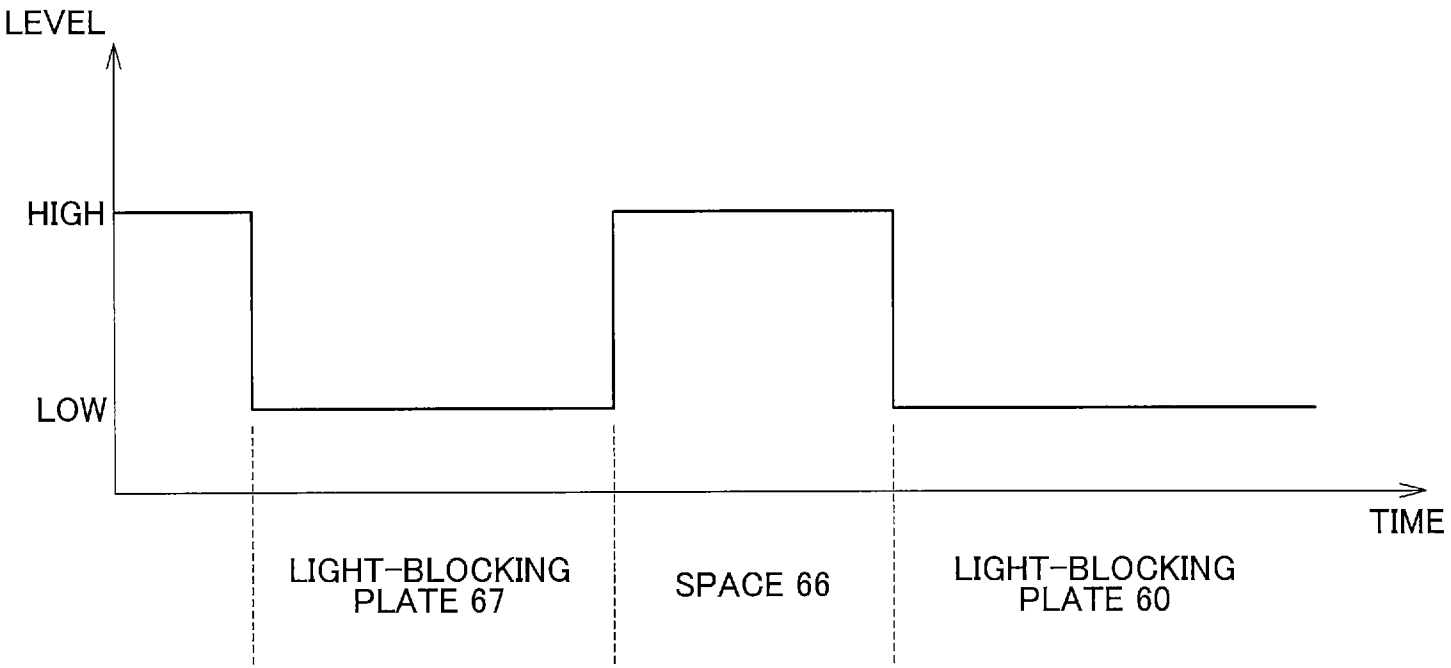
FIG. 13 is a view illustrating fluctuations of a signal outputted from the sensor of the cartridge-attachment section.

Referring to FIG. 13, the controller 130 is configured to determine whether the ink cartridge 30 is attached to the cartridge-attachment section 110 based on fluctuations in the signal outputted from the sensor 103 during the insertion of the ink cartridge 30 into the cartridge-attachment section 110.

Specifically, the controller 130 determines that a normal ink cartridge 30 is attached to the cartridge-attachment section 110 when the signal outputted from the sensor 103 changes: from high level to low level by the light-blocking plate 67 (upper portion 67U); then from low level to high level upon passage of the space 66; and from high level to low level again by the light-blocking plate 60 inside the detection portion 62. Here, the ink cartridge 30 is defined as being "normal" when: the ink cartridge 30 can be used in the printer 10; and a sufficient amount of ink (greater than an amount of ink to be determined as empty or near empty) is stored in the ink chamber 36 of the ink cartridge 30.

When the signal outputted from the sensor 103 fluctuates in a different way from that shown in FIG. 13, the controller 130 determines that an abnormal ink cartridge 30 is attached to the cartridge-attachment section 110. If this is the case, the controller 130 notifies the user that the attached ink cartridge 30 is abnormal through an error message on a display, for example.

Alternatively, the controller 130 may be configured to make a determination as to whether the ink cartridge 30 is attached to the cartridge-attachment section 110 in the following way. A cover sensor may be provided in the printer 10 to output a signal to the controller 130 when detecting that the opening 112 of the cartridge-attachment section 110 is closed by a cover. The controller 130 may start an electrical access to the IC board 64 upon receipt of the signal from the cover sensor. The controller 130 may determine that the (normal) ink cartridge 30 is attached to the cartridge-attachment section 110 upon detecting that: accessing to the information (reading) stored in the IC board 64 can be performed normally; and/or electrical connection to the IC board 64 can be established.

Next, a process for detaching the ink cartridge 30 from the cartridge-attachment section 110 will be described.

For detaching the ink cartridge 30 from the cartridge-attachment section 110, the user pushes the operation surface 92 of the ink cartridge 30 downward. In the attached posture of the ink cartridge 30 to the cartridge-attachment section 110 illustrated in FIG. 12, the operation surface 92 faces upward and reward. Hence, when the user operates the operation surface 92 of the ink cartridge 30 fixed in position in the cartridge-attachment section 110 (in the attached state), the ink cartridge 30 is applied with a force acting downward and forward. By the frontward force, the locking surface 151 is disengaged from the locking portion 145 of the cartridge-attachment section 110. By the downward force, the ink cartridge 30 is pivoted clockwise in FIG. 12.

Figure 12:
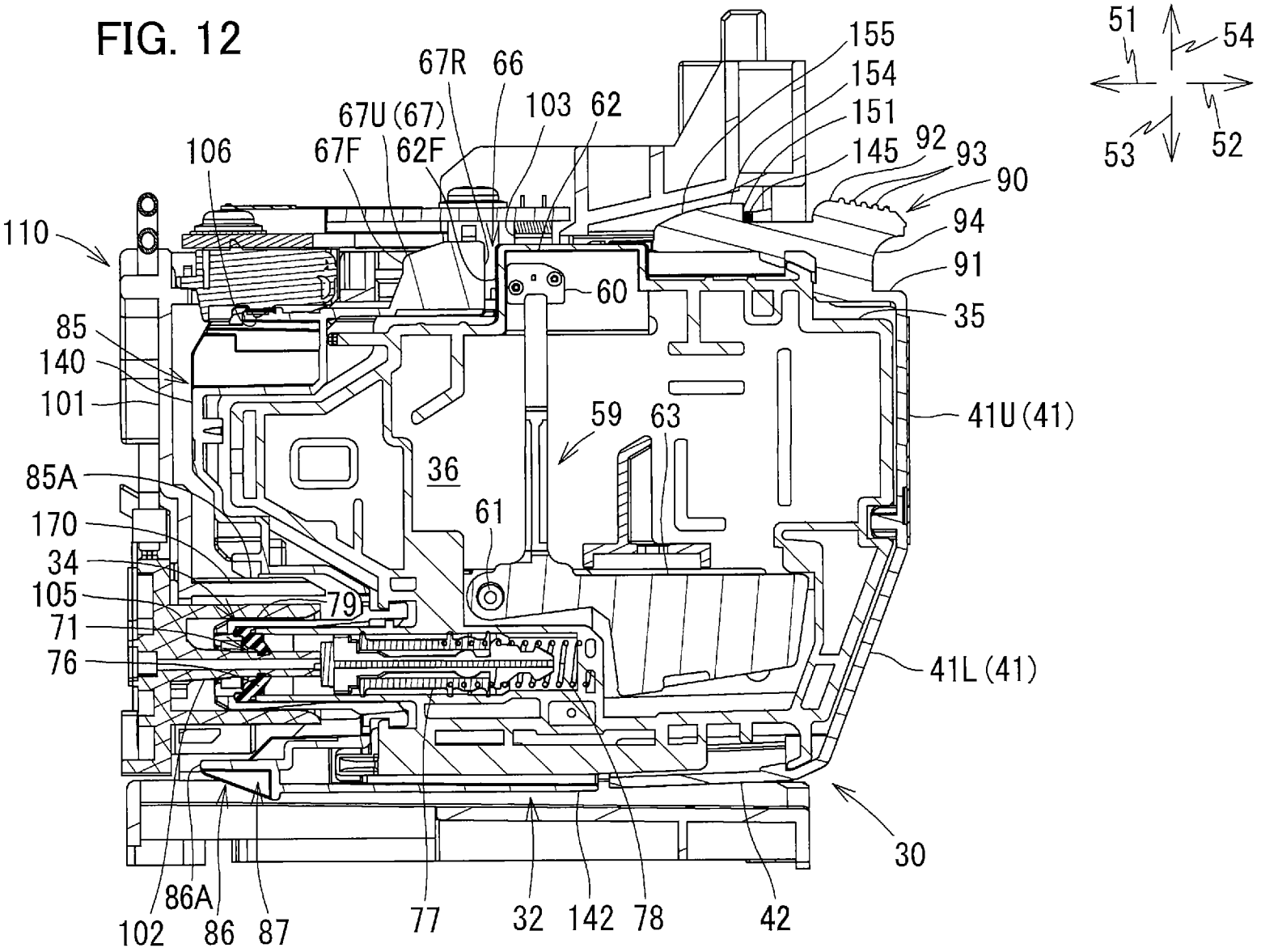
FIG. 12 is a vertical cross-sectional view illustrating the ink cartridge according to the embodiment and the cartridge-attachment section, and particularly illustrating a state where the ink cartridge is fixed in position relative to the cartridge-attachment section.

By this pivoting of the ink cartridge 30 in the clockwise direction in FIG. 12, the locking surface 151 is moved downward below the locking portion 145. The ink cartridge 30 is then caused to move rearward, relative to the cartridge-attachment section 110, due to the rearward urging force of the coil spring 78. The user can now grasp the rear cover 31 of the ink cartridge 30 to pull the same rearward, thereby removing the ink cartridge 30 from the cartridge-attachment section 110.

In accordance with the rearward movement of the ink cartridge 30 for removal, the space 66 and light-blocking plate 67 are also moved rearward to be displaced from the optical path of the sensor 103. The signal outputted from the sensor 103 to the controller 130 thus changes from high level to low level, and then from low level to high level, in accordance with the rearward movement of the space 66 and light-blocking plate 67.

The change in signal of the sensor 103 caused by detection of the front edge 67F and rear edge 67R of the light-blocking plate 67 may be utilized to determine whether the ink cartridge 30 is attached to the cartridge-attachment section 110, as well as to identify the kind of the ink cartridge 30 attached to the cartridge-attachment section 110 (for example, the color of ink stored in the attached ink cartridge 30).

Operational and Technical Advantages of the Embodiment

In the ink cartridge 30 according to the depicted embodiment, the upper portion 67U of the light-blocking plate 67 and grounding electrode 65C are arranged to cross the datum plane 180. That is, the upper portion 67U of the light-blocking plate 67 and grounding electrode 65C are positioned on the datum plane 180. With this structure, since the grounding electrode 65C is at the same widthwise position with the light-blocking plate 67 in the right-left direction 55, 56, the grounding electrode 65C is hard to interfere with the sensor 103 (which is configured to detect the light-blocking plate 67) during the insertion of the ink cartridge 30 into the cartridge-attachment section 110, Further, even if the ink cartridge 30 is inserted into the cartridge-attachment section 110 in a posture inclined laterally relative to the front-rear direction 51, 52 (or, even if the ink cartridge 30 is inserted in a posture pivoted in the right-left direction 55, 56 about the ink supply port 71 of the ink supply potion 34), the grounding electrode 65C, which has been once in contact with the corresponding contact 106, is less likely to be separated therefrom since the grounding electrode 65C is positioned at the widthwise center of the top wall 141. Hence, the electrical connection between the grounding electrode 65C and the contact 106 corresponding thereto can be stably maintained.

Further, even if the ink cartridge 30 is inserted into the cartridge-attachment section 110 in a posture inclined laterally relative to the front-rear direction 51, 52 (or, even if the ink cartridge 30 is inserted in a posture pivoted in the right-left direction 55, 56 about the ink supply port 71 of the ink supply potion 34), positions of the front edge 67F and rear edge 67R of the light-blocking plate 67 are less likely to be displaced with respect to the front-rear direction 51, 52.

In the ink cartridge 30 according to the depicted embodiment, the space 66 is provided between the light-blocking plate 67 and the detection portion 62 in the front-rear direction 51, 52. This structure can facilitate the optical detection of the rear edge 67R of the light-blocking plate 67 by the sensor 103. Further, in the signal output of the sensor 103, the optical detection of the light-blocking plate 67 and the optical detection of the detection portion 62 (light-blocking plate 60) are explicitly distinguishable from each other. Further, the light-blocking plate 67 and detection portion 62 (light-blocking plate 60) can be arranged generally at the same height as each other and, hence, can be optically detected by the single sensor 103 during the insertion of the ink cartridge 30 into the cartridge-attachment section 110.

Further, the left-right width L1 of the grounding electrode 65C is greater than the left-right width L2 of the top surface 67A of the light-blocking plate 67 on the upper surface of the ink cartridge 30, as illustrated in FIG. 6. With this structure, even if the ink cartridge 30 is inserted into the cartridge-attachment section 110 in a posture inclined laterally relative to the front-rear direction 51, 52 (or, even if the ink cartridge 30 is inserted in a posture pivoted in the right-left direction 55, 56 about the ink supply port 71 of the ink supply potion 34), the electrical connection between the grounding electrode 65C and the corresponding contact 106 can be maintained stably, and interference between the light-blocking plate 67 and the sensor 103 is less likely to occur.

Variations and Modifications

In the depicted embodiment, the space 66 is provided between the light-blocking plate 67 and detection portion 62 in the front-rear direction 51, 52. Alternatively, instead of providing the space 66, a light-transmission portion made of a material capable of transmitting light therethrough may be provided between the light-blocking plate 67 and detection portion 62 in the front-rear direction 51, 52. The light-transmission portion may be configured as a part of the light-blocking plate 67, or a part of the detection portion 62, or a discrete member independent of each of the light-blocking plate 67 and detection portion 62.

Figure 16:
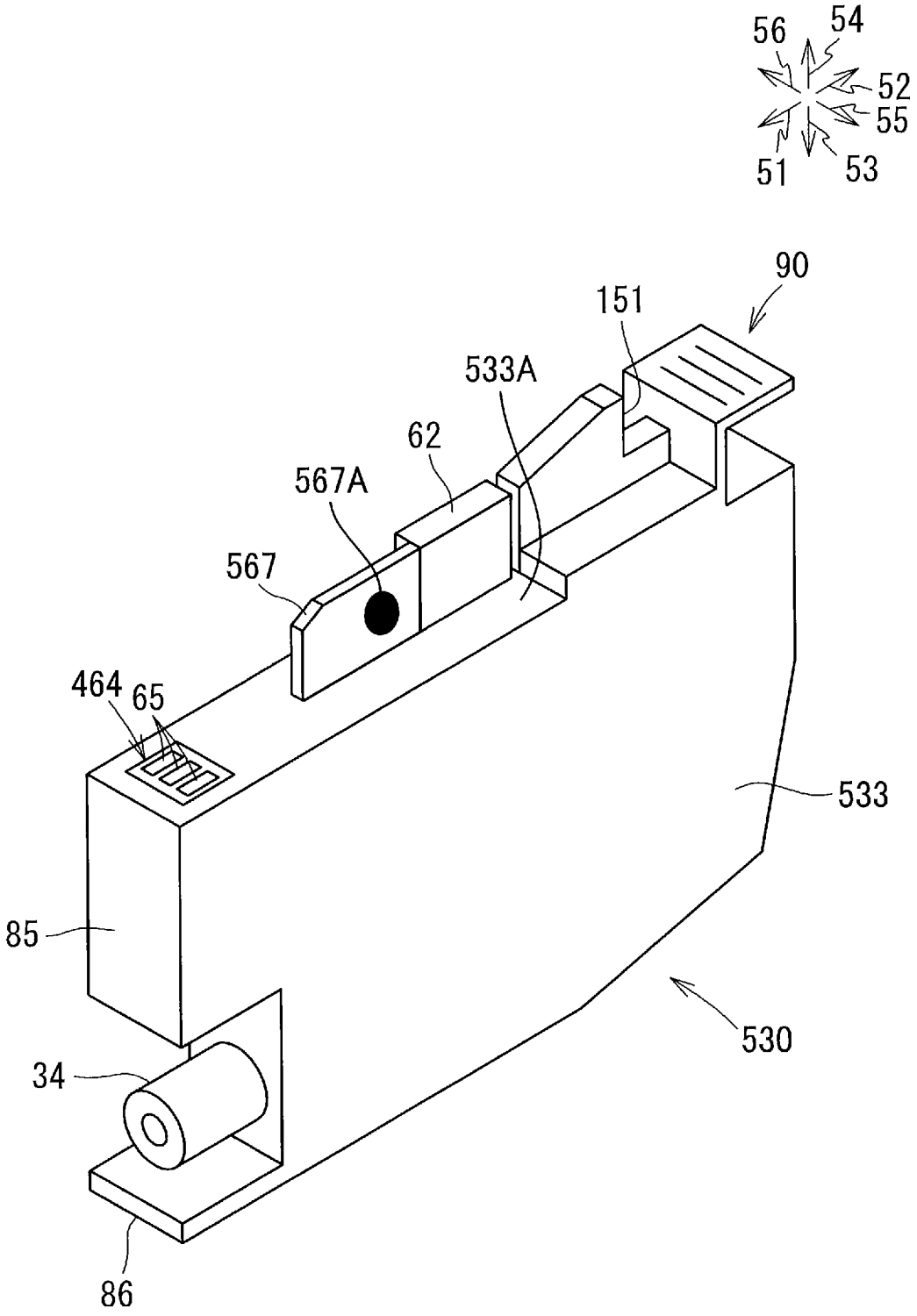
FIG. 16 is a perspective view of an ink cartridge according to a variation of the embodiment.

As an example, referring to FIG. 16, a plate 567 made of a transparent material configured to transmit light therethrough may be provided on a top surface 533A of a housing 533. In this ink cartridge 530 according to a variation of the embodiment, the plate 567 has a side surface on which a light-blocking portion 567A is formed. This light-blocking portion 567A may be formed by attaching or affixing a material configured to block light to the side surface, or by painting the side surface with a material configured to block light. With this structure as well, the light emitted from the sensor 103 can be blocked by the light-blocking portion 567A of the plate 567, and is then allowed to pass through a rear portion of the transparent plate 567 in the right-left direction 55, 56, and is again blocked by the light-blocking plate 60 accommodated in the detection portion 62. Hence, in this variation as well, the signal outputted from the sensor 103 can fluctuate in the same manner as in the embodiment, as illustrated in FIG. 13. That is, the rear portion of the transparent plate 567 functions as a light-transmission portion interposed between the light-blocking portion 567A and the light-blocking plate 60 in the detection portion 62, as in the same manner as the space 66 of the embodiment.

The electrode group 65 of the embodiment include only three electrodes: the power-supply electrode 65A, signal electrode 65B and the grounding electrode 65C. However, the electrode group 65 may include more than three electrodes.

Figure 14:
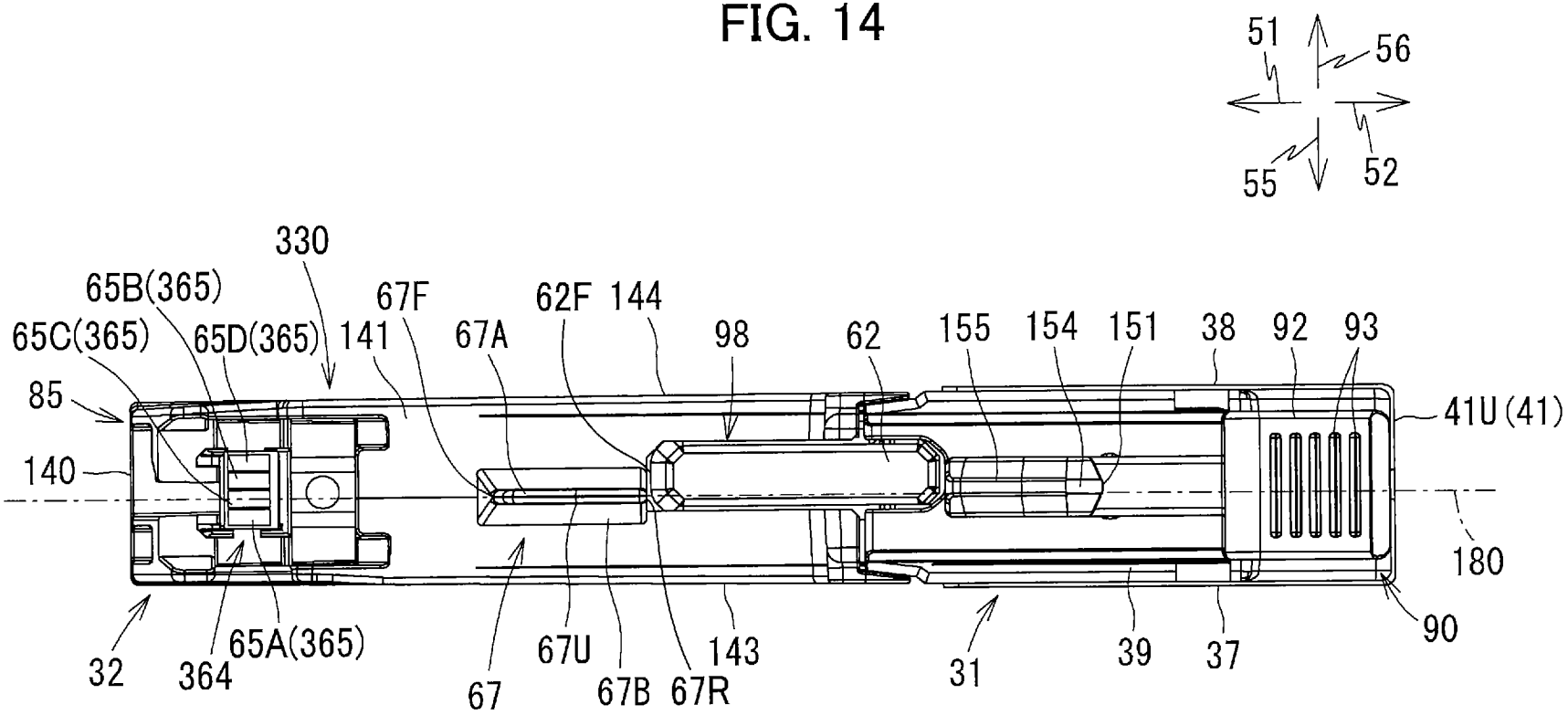
FIG. 14 is a top view of an ink cartridge according to a first modification to the embodiment.

For example, FIG. 14 illustrates an ink cartridge 330 according to a first modification to the embodiment. Instead of the electrode group 65, the ink cartridge 330 includes an electrode group 365. The electrode group 365 includes a dummy electrode 65D, in addition to the power-supply electrode 65A, the signal electrode 65B and the grounding electrode 65C. The dummy electrode 65D is electrically disconnected from the contact 106 of the cartridge-attachment section 110 even when the ink cartridge 330 is attached to the cartridge-attachment section 110. The dummy electrode 65D may be positioned outward of the power-supply electrode 65A or signal electrode 65B in the right-left direction 55, 56. That is, the power-supply electrode 65A may be interposed between the dummy electrode 65D and the grounding electrode 65C, or the signal electrode 65B may be interposed between the dummy electrode 65D and the grounding electrode 65C. In the example of FIG. 14, the dummy electrode 65D is positioned on the left of the signal electrode 65B and thus the signal electrode 65B is positioned between the dummy electrode 65D and the grounding electrode 65C in the right-left direction 55, 56.

Figure 15:
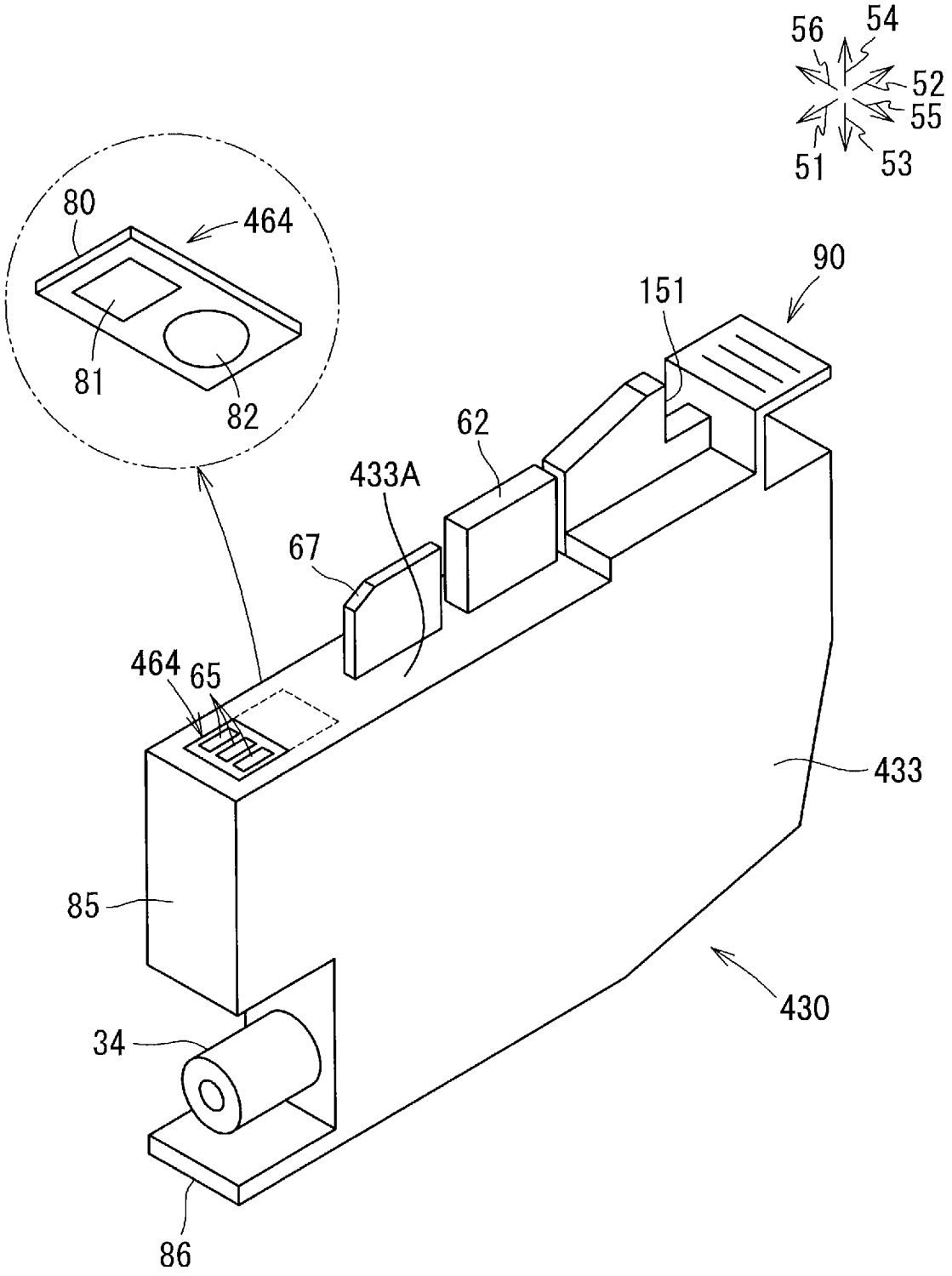
FIG. 15 is a perspective view of an ink cartridge according to a second modification to the embodiment.

FIG. 15 shows an ink cartridge 430 according to a second modification to the embodiment. The ink cartridge 430 includes an IC board 464, in place of the IC board 64 of the embodiment. The IC board 464 includes a substrate 80, the electrode group 65, an electrical circuit 81, and a battery 82. As illustrated in FIG. 15, the electrode group 65 is formed on an upper surface of the substrate 80, whereas the electrical circuit 81 and substrate 80 are mounted on a lower surface of the substrate 80 (see the enlarged portion of the substrate 80 enclosed by a phantom line in FIG. 15). Incidentally, the upper surface of the substrate 80 in its entirety need not be exposed to the outside. That is, only a part of the upper surface of the substrate 80 and the electrode group 65 may be exposed to the outside, and a remaining portion of the upper surface of the substrate 80 may be covered by a portion of a housing 433.

Further, the ink cartridge 430 of the second modification does not include the inner frame 35 inside the housing 433. That is, the inner frame 35 of the embodiment is not essential and may be dispensed with. A housing constituting an outer contour of an ink cartridge (such as the rear cover 31 and front cover 32 of the embodiment) may define an internal space therein serving as the ink chamber 36. In the ink cartridge 430 of the second modification, the housing 433 has a general box shape, and defines an internal space therein that serves as the ink chamber 36. In the housing 433, the detection portion 62 and IC board 464 and light-blocking plate 67 are arranged on a top surface 433A of the housing 433.

In the embodiment, the front end 86A of the second protruding portion 86 protrudes further frontward relative to the front end 34A of the ink supply potion 34 as best illustrated in FIG. 5. Alternatively, the front end 86A of the second protruding portion 86 may be positioned rearward of the front end 34A of the ink supply potion 34, or may be positioned at the same position as the front end 34A of the ink supply potion 34 in the front-rear direction 51, 52. Still alternatively, the second protruding portion 86 need not be formed in a tray-like shape, but may be constituted by a pair of protrusions spaced part from each other in the right-left direction 55, 56. That is, the second protruding portion 86 need not function to receive ink droplets that may be trickled down through the ink supply port 71 of the ink supply potion 34.

Note that, ink serves as an example of liquid of the disclosure in the above-described embodiment. However, the liquid of the disclosure is not limited to ink. For example, a pretreatment liquid that is to be ejected onto sheets prior to ink during a printing operation may be stored in the liquid cartridge of the disclosure. Alternatively, cleaning water for cleaning the recording head 21 may be stored in the liquid cartridge of the disclosure.

Remarks

The ink cartridge 30, 330, 430 is an example of a liquid cartridge. The ink supply potion 34 is an example of an ink supply potion. The rear cover 31, front cover 32, inner frame 35 together are an example of a housing. The IC board 64, 364 is an example of a circuit board. The light-blocking plate 67, and plate 567 is an example of a plate. The upper portion 67U is an example of an upper portion. The detection portion 62 and the light-blocking plate 60 together are an example of a detection portion. The electrode group 65, 365 is an example of an electrode group. The power-supply electrode 65A and signal electrode 65B are examples of first and second electrodes. The grounding electrode 65C is an example of a third electrode. The datum plane 180 is an example of a datum plane. The dummy electrode 65D is an example of a dummy electrode. The second protruding portion 86 is an example of a protruding portion. The light-blocking plate 60 is an example of a light-receiving portion and an example of a light-blocking plate. The upper portion 67U of the light-blocking plate 67, and the light-blocking portion 567A of the plate 567 are examples of a light-blocking portion.

What is claimed is:

1. A liquid cartridge comprising:

a housing defining therein a liquid chamber for storing liquid, the housing comprising a cover formed with an opening;

a liquid supply portion protruding in a frontward direction crossing a gravitational direction from a front surface of the housing, and configured to supply the liquid in the liquid chamber to an outside of the liquid cartridge;

a circuit board comprising an electrode group and having a width in a lateral direction crossing the frontward direction and the gravitational direction, the electrode group facing upward in an upright posture of the liquid cartridge and being exposed to the outside, the electrode group comprising a first electrode, a second electrode, and a third electrode;

a plate provided at the cover and having an upper portion, the plate being positioned upward and rearward relative to the circuit board and extending in the frontward direction in the upright posture of the liquid cartridge; and a detection portion exposed upward through the opening of the cover such that the detection portion is positioned upward and rearward relative to the circuit board in the upright posture of the liquid cartridge, wherein the first electrode, the second electrode and the third electrode are arrayed in the lateral direction such that the third electrode is positioned between the first electrode and the second electrode in the lateral direction, the third electrode being an electrode for grounding, each of the third electrode and the upper portion of the plate is positioned on a datum plane extending in the frontward direction and in the gravitational direction, and the upper portion of the plate has a rear end that is positioned closer to the third electrode than the opening is to the third electrode in the frontward direction.

2. The liquid cartridge according to claim 1, wherein the detection portion and the plate are arranged with a gap defined therebetween in the frontward direction.

3. The liquid cartridge according to claim 1, wherein the detection portion is configured to receive light traveling in the lateral direction, wherein the plate is a transparent plate having a light-blocking portion configured to block the light traveling in the lateral direction, and wherein the detection portion and the light-blocking portion are arranged with a light-transmission portion interposed therebetween in the frontward direction, the light-transmission portion being configured to allow the light to pass therethrough.

4. The liquid cartridge according to claim 1, wherein the plate is a light-blocking plate configured to block light traveling in the lateral direction.

5. The liquid cartridge according to claim 4, wherein the third electrode has a width in the lateral direction greater than a width in the lateral direction of a top surface of the upper portion of the plate.

6. The liquid cartridge according to claim 1, wherein the electrode group consists of the first electrode, the second electrode and the third electrode, and wherein the first electrode is an electrode for power supply, and the second electrode is a signal electrode for exchanging signals.

7. The liquid cartridge according to claim 6, wherein the upper portion of the plate has a constant width in the lateral direction across an entire length of the upper portion in the frontward direction.

8. The liquid cartridge according to claim 1, wherein the third electrode defines a widthwise center in the lateral direction, the widthwise center being positioned on the datum plane.

9. The liquid cartridge according to claim 1, wherein the electrode group further comprises a dummy electrode electrically disconnected from a printer in an attached state of the liquid cartridge to the printer, and wherein one of the first electrode and the second electrode is positioned between the third electrode and the dummy electrode in the lateral direction.

10. The liquid cartridge according to claim 1, further comprising a protruding portion protruding frontward from the front surface of the housing at a position below the liquid supply potion, the protruding portion having a front end that is positioned forward of a front end of the liquid supply potion in the frontward direction.

11. The liquid cartridge according to claim 1, wherein the detection portion comprises a light-receiving portion on which light traveling in the lateral direction is incident, wherein the plate comprises a light-blocking portion on which the light is incident, wherein the light-receiving portion and the light-blocking portion are arranged to be spaced apart from each other in the frontward direction.

12. The liquid cartridge according to claim 11, wherein each of the light-receiving portion and the light-blocking portion is configured to receive the light during an insertion of the liquid cartridge into a printer.

13. The liquid cartridge according to claim 11, wherein the light-receiving portion is a light-blocking plate movable from a first position to a second position in accordance with the amount of the liquid stored in the liquid chamber, the light-blocking plate at the first position being on a path of the light, and the light-blocking plate at the second position being displaced from the path of the light, and wherein the light-blocking plate at the first position is positioned higher than an upper surface of the housing in the upright posture of the liquid cartridge.

14. The liquid cartridge according to claim 1, wherein the circuit board, the plate and the detection portion are disposed at an upper surface of the housing.

15. The liquid cartridge according to claim 1, wherein the plate has a lower portion positioned below the upper portion and connecting the upper portion to an upper surface of the cover, the lower portion having a tapered shape whose width in the lateral direction becomes smaller toward the upper portion.

16. The liquid cartridge according to claim 1, wherein the liquid supply portion defines a center positioned on the datum plane.

17. The liquid cartridge according to claim 1, wherein the circuit board comprises:

a substrate having a first surface and a second surface opposite each other, the electrode group being provided on the first surface of the substrate; and an electrical circuit mounted on the second surface of the substrate.

18. The liquid cartridge according to claim 17, wherein the circuit board further comprises a battery mounted on the second surface of the substrate and electrically connected to the electrical circuit.

19. The liquid cartridge according to claim 1, wherein the circuit board and the plate are fixed to an upper wall of the cover.

20. The liquid cartridge according to claim 19, wherein the housing further comprises an inner frame defining the liquid chamber therein, the detection portion being provided at the inner frame, and wherein the cover covers the inner frame such that the detection portion is exposed upward through the opening of the cover.

* * * * *